US010248070B2

(12) United States Patent
Nunokawa et al.

(10) Patent No.: US 10,248,070 B2
(45) Date of Patent: Apr. 2, 2019

(54) TRANSPORTATION APPARATUS

(71) Applicant: SEIKO EPSON CORPORATION, Tokyo (JP)

(72) Inventors: Yohei Nunokawa, Nagano (JP); Yasuhiko Yoshihisa, Nagano (JP); Takayuki Tanaka, Nagano (JP); Kohei Kozaki, Nagano (JP); Kensuke Tamai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 74 days.

(21) Appl. No.: 15/412,339

(22) Filed: Jan. 23, 2017

(65) Prior Publication Data

US 2017/0227908 A1 Aug. 10, 2017

(30) Foreign Application Priority Data

Feb. 9, 2016 (JP) ..... 2016/022411

(51) Int. Cl.
*G03G 15/00* (2006.01)

(52) U.S. Cl.
CPC ..... *G03G 15/607* (2013.01)

(58) Field of Classification Search
CPC ..... G03G 15/65; G03G 15/6502; G03G 15/6505; G03G 15/6508; G03G 15/5095; G03G 15/6511; G03G 15/6514; G03G 15/6517
See application file for complete search history.

(56) References Cited

U.S. PATENT DOCUMENTS 5,692,110 A * 11/1997 Miyasaka ..... B41J 11/42 358/1.1
2007/0057446 A1* 3/2007 Nishimura ..... B65H 43/00 271/258.03
2007/0071468 A1* 3/2007 Yako ..... G03G 15/5029 399/45
2013/0141487 A1* 6/2013 Abe ..... B41J 11/00 347/16
2015/0172498 A1* 6/2015 Inoue ..... H04N 1/00689 358/1.12

FOREIGN PATENT DOCUMENTS

JP 2012-192988 A 10/2012

* cited by examiner

*Primary Examiner* — David H Banh

(57) ABSTRACT

There is provided a transportation apparatus in which a first transportation unit, which transports a paper sheet from a mounting portion, starts transportation of a next paper sheet at a time when a specific time has elapsed after the second transportation unit, which is positioned on a downstream side of the first transportation unit, starts to transport a paper sheet so that an inter-sheet distance between a preceding paper sheet and a following paper sheet becomes optimal.

13 Claims, 13 Drawing Sheets

TRANSPORTATION APPARATUS

BACKGROUND

1. Technical Field

The present invention relates to a transportation apparatus.

2. Related Art

A scanner that is provided with an auto document feeder (ADF) can transport a plurality of documents placed on a document tray using the ADF and can read the plurality of documents consecutively.

A sheet transportation apparatus, which is provided with a length detection unit that detects whether or not a length in a transportation direction of a document sheet mounted on a document mounting section is equal to a predetermined standard length, a trailing end detection sensor that detects a trailing end of the document sheet being positioned on a downstream side of a separation and transportation section, and a first leading end detection sensor that detects a leading end of the document sheet being positioned in a predetermined position on the downstream side of the trailing end detection sensor in the transportation direction, has been known (refer to JP-A-2012-192988). In the sheet transportation apparatus, in a case where the result of the detection performed by the length detection unit indicates that the length is not equal to the standard length, timing of trailing end detection performed by the trailing end detection sensor is used as timing of rotation driving start of a pick-up roller, and in a case where the result of the detection indicates that the length is equal to the standard length, timing of leading end detection performed by the first leading end detection sensor is used as the timing of the rotation driving start.

In order to improve transportation efficiency of the ADF, a distance (hereinafter, inter-sheet distance) between paper sheets to be transported may be reduced. In order to reduce the inter-sheet distance, a dedicated sensor for acquiring timing of transportation start may be provided in the middle of a paper sheet transportation path so that transportation of a subsequent paper sheet is started at a time when an end portion of a paper sheet which is being transported is detected by the sensor. However, in this case, the dedicated sensor is needed to be provided, which results in an increase in product cost. Also in JP-A-2012-192988, a plurality of sensors of the trailing end detection sensor, the first leading end detection sensor, and the length detection unit, are needed to be provided, which results in an increase in product cost.

SUMMARY

An advantage of some aspects of the invention is to provide a transportation apparatus with which it is possible to achieve cost reduction and efficient transportation at the same time.

According to an aspect of the invention, there is provided a transportation apparatus including a first transportation unit that transports a paper sheet from a mounting portion on which the paper sheet is mounted, a second transportation unit that transports the paper sheet transported by the first transportation unit being positioned on a downstream side of the first transportation unit in a transportation direction, a processing unit that executes predetermined processing with respect to the paper sheet transported by the second transportation unit, and a controller that controls driving of the first transportation unit and the second transportation unit. The controller measures a transportation time of an Nth paper sheet (N is an integer of 1 or more) until the processing unit finishes processing with respect to the Nth paper sheet, determines a specific time which is shorter than the transportation time on the basis of the transportation time, and causes the first transportation unit to start transportation of a next paper sheet at a time when the specific time has elapsed after the second transportation unit starts to transport a paper sheet in a case where the second transportation unit transports (N+1)th and subsequent paper sheets.

According to this configuration, in the transportation of the (N+1)th and subsequent paper sheets, the first transportation unit starts to transport a next paper sheet before the processing unit finishes processing with respect to one paper sheet (decrease in inter-sheet distance). Therefore, the transportation becomes efficient and the throughput of the transportation apparatus is increased. In addition, the above-described effects can be achieved without adding a dedicated sensor or the like.

In the transportation apparatus, the first transportation unit may be driven by a first motor, the second transportation unit may be driven by a second motor, and the controller may individually control driving of the first motor and driving of the second motor.

According to this configuration, the first transportation unit and the second transportation unit are driven by different driving sources. Therefore, it becomes easy to control driving of the first transportation unit and driving of the second transportation unit individually.

In the transportation apparatus, the processing unit may be an image reading unit which executes reading processing with respect to the paper sheet transported by the second transportation unit.

According to this configuration, it is possible to reduce the total time taken for reading processing of a plurality of paper sheets.

The transportation apparatus may further include an end portion detection sensor that detects an end portion of a paper sheet being positioned on a downstream side of the mounting portion in the transportation direction and on a upstream side of the second transportation unit in the transportation direction. The controller may calculate the specific time by subtracting Y from X, where X is the time taken from when the first transportation unit starts to transport the paper sheet from the mounting portion to when a leading end of the transported paper sheet is detected by the end portion detection sensor and Y is the transportation time.

According to this configuration, it is possible to achieve a state where the processing unit has finished processing with respect to one of the (N+1)th and subsequent paper sheets and a leading end of the next paper sheet has reached the end portion detection sensor after the time Y has elapsed after the second transportation unit starts to transport the paper sheet, where Y>X.

In the transportation apparatus, the controller may measure and update the time X each time when the first transportation unit transports a paper sheet.

According to this configuration, it is possible to more properly calculate the specific time while obtaining the time X that is slightly different for each paper sheet.

In the transportation apparatus, the controller may execute inclination correction processing in which the first transportation unit is further driven in a state where a leading end of a paper sheet transported by the first transportation unit is in contact with the second transportation unit being stopped so that the second transportation unit transports the paper sheet having been subject to the inclination correction processing.

According to this configuration, due to the inclination correction processing, the paper sheet can be subject to the processing performed by the processing unit being in a proper posture.

In the transportation apparatus, the controller may not execute the inclination correction processing during a period from when the second transportation unit starts to transport a paper sheet to when the processing unit finishes the processing.

According to this configuration, processing with respect to a paper sheet which is performed by the processing unit is not stopped by the inclination correction processing.

In the transportation apparatus, the second transportation unit may be provided with a discharging unit that discharges a transported paper sheet being positioned on a downstream side of the processing unit in the transportation direction, and transportation of a paper sheet to be subject to the processing in the processing unit and discharging of a paper sheet having been subject to the processing in the processing unit which is performed by the discharging unit may be executed being synchronized with each other.

According to this configuration, transportation of a paper sheet to be subject to the processing in the processing unit and discharging of a paper sheet having been subject to the processing in the processing unit can be executed at the same time.

In the transportation apparatus, the controller may measure and update the transportation time each time when the second transportation unit transports a paper sheet.

According to this configuration, it is possible to more properly calculate the specific time while obtaining the transportation time that varies due to the difference in size of transported paper sheets.

The transportation apparatus may further include an end portion detection sensor that detects an end portion of a paper sheet being positioned on a downstream side of the mounting portion in the transportation direction and on a upstream side of the second transportation unit in the transportation direction. The controller may calculate a length of a paper sheet in the transportation direction on the basis of transportation of the paper sheet performed by the second transportation unit, speed up the transportation of a paper sheet which is performed by the first transportation unit in a case where a time at which a trailing end of a paper sheet which the second transportation unit starts to transport is detected by the end portion detection sensor is earlier than timing of detection expected from the calculated length of the paper sheet, and temporarily stop the transportation of a paper sheet which is performed by the first transportation unit in a case where the time at which the trailing end of the paper sheet which the second transportation unit starts to transport is detected by the end portion detection sensor is later than the expected timing of detection.

According to this configuration, even in a case where a length of the paper sheet which the second transportation unit starts to transport is not equal to a length of the paper sheet expected on the basis of transportation of a preceding paper sheet performed by the second transportation unit, it is possible to make an inter-sheet distance between the paper sheet transported by the second transportation unit and the next paper sheet optimal.

In the transportation apparatus, after the controller speeds up the transportation of a paper sheet which is performed by the first transportation unit, in a case where a leading end of a paper sheet transported by the first transportation unit is detected by the end portion detection sensor, the controller may temporarily stop the transportation of the paper sheet which is performed by the first transportation unit before the leading end comes into contact with the second transportation unit, and the controller may restart the transportation of the paper sheet which is performed by the first transportation unit after the processing unit finishes processing with respect to the paper sheet transported by the second transportation unit.

According to this configuration, it is possible to avoid that the next paper sheet reaches the second transportation unit before the processing unit finishes processing with respect to the paper sheet transported by the second transportation unit.

In the transportation apparatus, after the controller temporarily stops the transportation of a paper sheet which is performed by the first transportation unit since the time at which the trailing end of the paper sheet which the second transportation unit starts to transport is detected by the end portion detection sensor is later than the expected timing of detection, the controller may restart the transportation of the paper sheet which is performed by the first transportation unit after the processing unit finishes processing with respect to the paper sheet transported by the second transportation unit.

According to this configuration, it is possible to avoid a paper jam which is caused by a trailing end of a paper sheet transported by the second transportation unit being in contact with a leading end of the next paper sheet.

In the transportation apparatus, the first transportation unit may include an one-way clutch that transmits a rotational force only in a paper sheet feeding direction being positioned on a downstream side of the first transportation unit in the transportation direction.

According to this configuration, even in a state where the first transportation unit is stopped with one paper sheet being in contact with the second transportation unit and the first transportation unit, the paper sheet can be transported by using the second transportation unit.

The technical idea of the invention can also be implemented as other forms than the transportation apparatus. For example, a method (transportation method) including a step realized by the transportation apparatus, a program causing a hardware (for example, a computer built into the transportation apparatus) to execute the method, a computer-readable storage medium that stores the program, and the like can be regarded as inventions.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. Each drawing is merely an example for description of the embodiments.

1. Schematic Configuration of Apparatus

Figure 1:
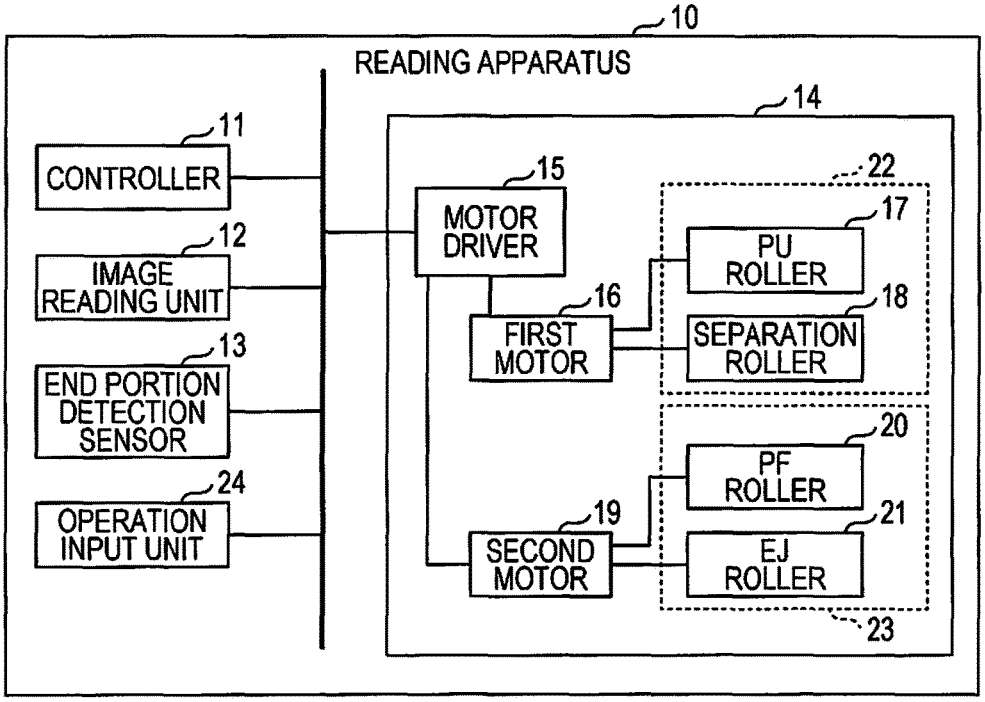
FIG. 1 is a block diagram schematically illustrating a configuration of a reading apparatus.

FIG. 1 is a block diagram schematically illustrating a configuration of a reading apparatus 10 according to an embodiment. The reading apparatus 10 is an apparatus that transports and reads a sheet-shaped medium (paper sheet) which is a processing target. Since the reading apparatus 10 has a function of transporting the medium as described above, the reading apparatus 10 can be called a transportation apparatus. Specifically, the reading apparatus 10 is understood as a product such as a scanner, or a multifunction machine with a plurality of functions of a scanner, a printer, a facsimile machine or the like. In the embodiment, the description will be made on the assumption that the medium is a paper sheet. However, materials other than paper also can be a processing target.

In FIG. 1, the reading apparatus 10 including a controller 11, an image reading unit 12, an end portion detection sensor 13, a transportation mechanism 14, and an operation input unit 24, is exemplified. The controller 11 is constituted by, for example, an IC including a CPU, a ROM, a RAM and the like, other recording mediums and the like. In the controller 11, the CPU executes calculation processing according to a program stored in the ROM and the like using the RAM and the like as a working area, to control behaviors of each component in the reading apparatus 10. The controller 11 also controls driving of a first transportation unit 22 and a second transportation unit 23, which will be described later. The operation input unit 24 includes various button keys, a touch panel, or the like to receive user operations.

The image reading unit 12 is a unit that optically reads (scan) a paper sheet transported by the transportation mechanism 14, and includes a light source that irradiates a paper sheet, an optical system that guides light reflected from a paper sheet, an image sensor that receives the reflected light and outputs the result of a reading operation (read data) on a paper sheet through photoelectric conversion, and the like. The read data may be stored in a recording medium inside or outside the reading apparatus 10, and may be used in printing.

The end portion detection sensor 13 is a sensor that can detect an end portion (leading end and trailing end) of a paper sheet transported by the transportation mechanism 14. The detection result of the end portion detection sensor 13 is output to the controller 11.

The transportation mechanism 14 corresponds to an ADF. The transportation mechanism 14 according to the embodiment includes a motor driver 15. The motor driver 15 is constituted by an IC, an analog circuit, or the like and supplies driving current to a plurality of motors (first motor 16 and second motor 19) according to a control signal from the controller 11 to drive motors 16 and 19 individually. The motor driver 15 may be divided into respective dedicated circuits of motors 16 and 19. The motor driver 15 may be understood as being included in the concept of the controller.

The first motor 16 is connected to each of a pick-up (PU) roller 17 and a separation roller 18 via a gear train or the like and the first motor 16 can rotate the rollers 17 and 18.

The second motor 19 is connected to each of a transportation (PF) roller 20 and a discharging (EJ) roller 21 via a gear train or the like and the second motor 19 can rotate the rollers 20 and 21.

Figure 2:
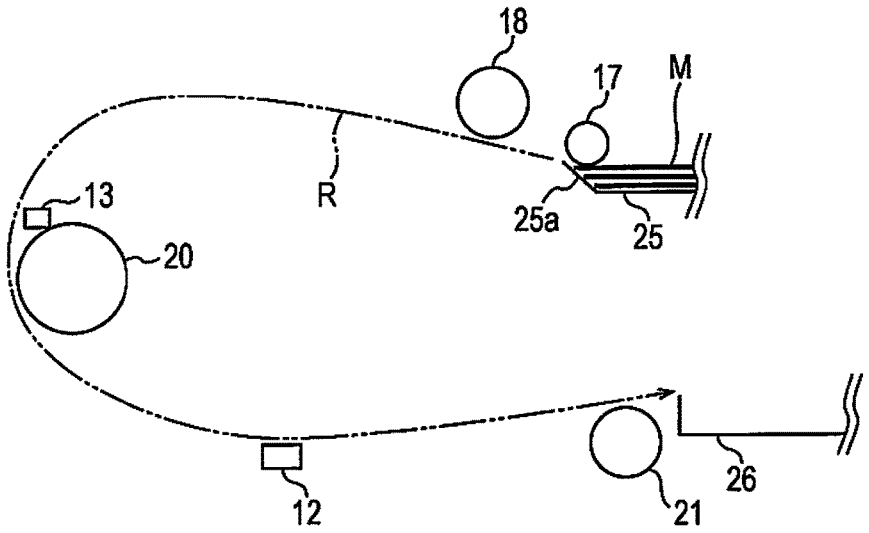
FIG. 2 is a view schematically illustrating a configuration including a paper sheet transportation path.

FIG. 2 schematically illustrates a configuration including a transportation path R of a paper sheet M in the reading apparatus 10. A document tray 25 is disposed on the most upstream side of the transportation path R which is indicated by an arrow of a two-dot chain line. The document tray 25 corresponds to a mounting portion on which paper sheets M are mounted and in FIG. 2, a plurality of paper sheets M are mounted on the document tray 25. Meanwhile, below the document tray 25, a discharging tray 26 is disposed. A paper sheet M transported along the transportation path R is discharged to the discharging tray 26 which is positioned on the most downstream side of the transportation path R. In FIG. 2, the transportation path R has a curved U-like shape and connects the document tray 25 and the discharging tray 26.

Paper sheets M mounted on the document tray 25 are drawn into the transportation path R when the PU roller 17 rotates, are separated one by one being in contact with the separation roller 18, and are transported to a downstream side in a transportation direction (hereinafter, downstream side). The rollers 17 and 18 correspond to a specific example of the first transportation unit 22 that transports a paper sheet M from the mounting portion. The rollers 17 and 18 and the first motor 16 for driving the rollers 17 and 18 may be collectively called the first transportation unit 22.

At a predetermined position in the middle of the transportation path R, the PF roller 20 is disposed and a paper sheet M is transported to the further downstream side when the PF roller 20 rotates. The PF roller 20 corresponds to a specific example of the second transportation unit 23 that transports a paper sheet M transported by the first transportation unit 22 being positioned on the downstream side of the first transportation unit 22. At a predetermined position on the downstream side of the PF roller 20, the image reading unit 12 is in a stationary state. The image reading unit 12 reads a paper sheet M that is transported by the PF roller 20 and the like along the transportation path R being in the stationary state. The image reading unit 12 is a specific example of a processing unit that executes predetermined processing with respect to a paper sheet M transported by the second transportation unit 23. The image reading unit 12 may also have a function of reading a document placed on a document table (not shown) while moving in a predetermined direction.

At a predetermined position on the downstream side of the processing unit (image reading unit 12), the EJ roller 21 that discharges a paper sheet M transported by the PF roller 20 (to the discharging tray 26) is disposed. The EJ roller 21 is a specific example of a discharging unit and may be understood as a portion of the second transportation unit 23. As described above, the second motor 19 causes the rollers 20 and 21 to rotate. Accordingly, transportation of a paper sheet M to be subject to the processing in the processing unit (image reading unit 12) which is performed by the PF roller 20 and discharging of a paper sheet M having been subject to the processing in the processing unit (image reading unit 12) which is performed by the EJ roller 21 are executed being synchronized with each other as described later. The rollers 20 and 21 and the second motor 19 for driving the rollers 20 and 21 may be collectively called the second transportation unit 23.

At a predetermined position on the downstream side of the document tray 25 and on an upstream side in the transportation direction (hereinafter, upstream side) of the PF roller 20, the end portion detection sensor 13 is disposed. In FIG. 2, the end portion detection sensor 13 is positioned on the slightly upstream side of the PF roller 20. Accordingly, a leading end of a paper sheet M detected by the end portion detection sensor 13 right before the paper sheet M reaches the PF roller 20.

A leading end of a paper sheet M is an end portion of the paper sheet M facing the downstream side of the transportation path R and a trailing end of a paper sheet M is an end portion of the paper sheet M facing the upstream side of the transportation path R. Although not shown in the drawings, in the vicinity of the transportation path R, a member that guides (restricts) a paper sheet M to move along the transportation path R is appropriately disposed.

Referring to the above-described configurations, several embodiments will be described below.

2. First Embodiment

Figure 3:
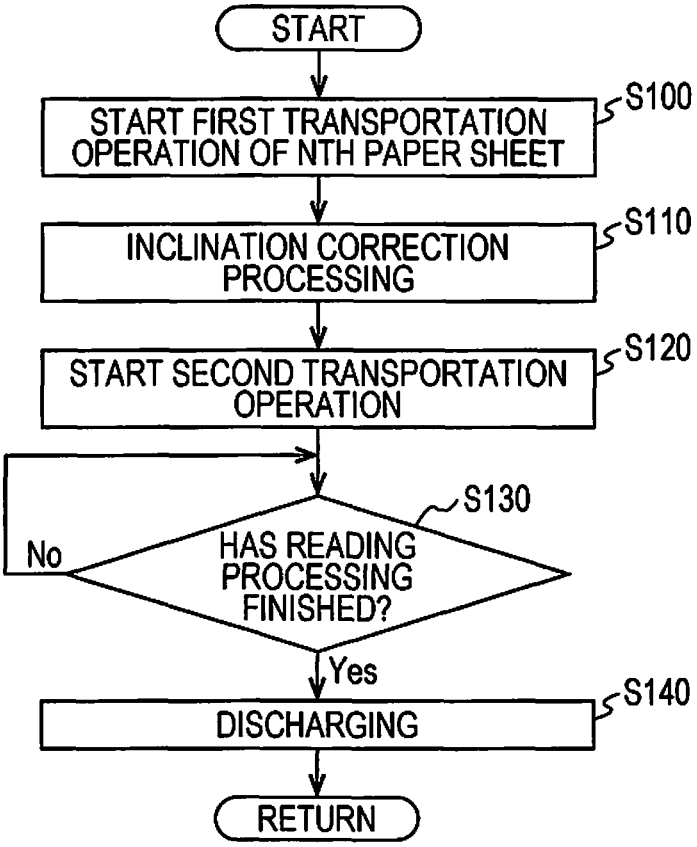
FIG. 3 is a flow chart illustrating transportation processing with respect to an Nth paper sheet.

FIG. 3 is a flow chart illustrating transportation processing with respect to an Nth paper sheet M (N is an integer of 1 or more) which is executed under control of the controller 11.

Figure 4:
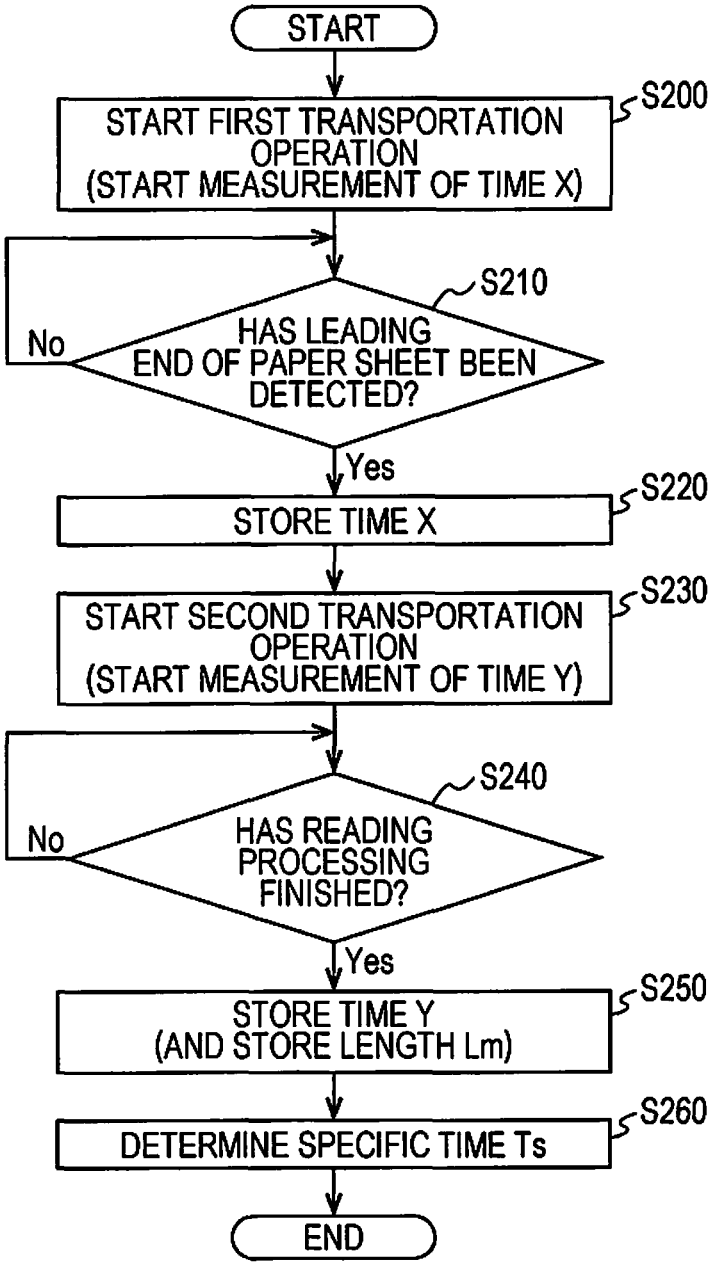
FIG. 4 is a flow chart illustrating measurement processing.

FIG. 4 is a flow chart illustrating measurement processing of each time which is executed under control of the controller 11.

The transportation processing and the measurement processing are executed in parallel. Here, for convenience of explanation, it is assumed that N=1. That is, it is assumed that the transportation processing in FIG. 3 is executed using the uppermost paper sheet M (first paper sheet M) of the plurality of paper sheets M mounted on the document tray 25 as the transportation target.

When an instruction to start a document reading operation is issued from the document tray 25, the controller 11 starts a first transportation operation (Step S100). The instruction to start the document reading operation is, for example, pushing of a start button, which the operation input unit 24 includes, or the like. The first transportation operation means a transportation operation of a paper sheet M performed by the first transportation unit 22 and is also called a paper feeding operation. That is, the controller 11 starts driving of the first motor 16 using the motor driver 15 to cause the PU roller 17 and the separation roller 18 to rotate so that an Nth (first) paper sheet M is transported from the document tray 25.

After the first transportation operation is started, the controller 11 executes inclination correction processing with respect to the paper sheet M that is transported along the transportation path R (Step S110). The inclination correction processing is processing in which the first transportation unit 22 is further driven in a state where a leading end of a paper sheet M transported by the first transportation unit 22 (rollers 17 and 18) is in contact with the PF roller 20 being stopped. In the inclination correction processing, the paper sheet M is pushed from the upstream side with a leading end thereof being held. Therefore, inclination with respect to a direction along the transportation path R is corrected and the posture of the paper sheet M becomes ideal. The time taken for the inclination correction processing is a several tens of milliseconds, which is short. The controller 11 stops the first transportation operation when the inclination correction processing ends. Stopping the first transportation operation is stopping the driving of the first motor 16 using the motor driver 15.

After the inclination correction processing, the controller 11 starts a second transportation operation (Step S120). The second transportation operation means a transportation operation of a paper sheet M performed by the second transportation unit 23. That is, the controller 11 starts driving of the second motor 19 using the motor driver 15 to cause the PF roller 20 and the EJ roller 21 to rotate so that the paper sheet M is transported toward the downstream side of the PF roller 20 along the transportation path R.

After the second transportation operation is started, the controller 11 continuously determines whether reading processing with respect to the paper sheet M in the middle of the second transportation operation has ended or not (Step S130). When a leading end of the paper sheet M is detected by the image reading unit 12 (image sensor) after the second transportation operation is started, the reading processing with respect to the paper sheet M which is performed by the image reading unit 12 is started. In addition, the image reading unit 12 finishes the reading processing with respect to the paper sheet M when a trailing end of the paper sheet M is detected. The controller 11 determines that the reading processing has ended when a signal indicating the end of the reading processing is input from the image reading unit 12 (Yes in Step S130).

At a time after the second transportation operation is started, the trailing end of the paper sheet M passes through the separation roller 18, and after a certain time has passed, the trailing end of the paper sheet M passes through the PF roller 20. Then, during a period in which the paper sheet M is transported only by the EJ roller 21 rotating, the reading processing ends. The controller 11 discharges the paper sheet M having been subject to the reading processing (Step S140). The discharging in Step S140 is executed by only continuously rotating the PF roller 20 and the EJ roller 21. Therefore, it can be said that the discharging is substantially a portion of the second transportation operation. As a result of the discharging, the Nth (first) paper sheet M is discharged into the discharging tray 26.

Although Steps S200, S230, and S240 of steps shown in FIG. 4, are substantially the same as Steps S100, S120, and S130 shown in FIG. 3, for convenience of explanation, those steps are described in FIG. 4 also. The controller 11 starts the first transportation operation of a paper sheet M from the document tray 25 (Step S200). At this time, the controller 11 starts to measure a time X using a timer.

After the first transportation operation is started, the controller 11 continuously determines whether a leading end of the paper sheet M in the middle of the first transportation operation is detected by the end portion detection sensor 13 or not (Step S210). When a detection signal indicating that the leading end of the paper sheet M is detected is input from the end portion detection sensor 13, the controller 11 determines "Yes" in Step S210, stops the measurement of the time X, and stores the measured time X (Step S220). Through Step S220, the time X taken from when the first transportation unit 22 starts to transport the paper sheet M from the document tray 25 to when the leading end of the transported paper sheet M is detected by the end portion detection sensor 13 is obtained.

Thereafter, the controller 11 starts the second transportation operation of the paper sheet M (Step S230). At this time, the controller 11 starts to measure a time Y using the timer. After the second transportation operation is started, the controller 11 continuously determines whether the reading processing with respect to the paper sheet M in the middle of the second transportation operation has ended or not (Step S240). When it is determined that the reading processing has ended ("Yes" in Step S240), the controller 11 stops the measurement of the time Y and stores the measured time Y (Step S250).

Through Step S250, the time Y taken from when the second transportation unit 23 starts the second transportation operation of the paper sheet M to when the image reading unit 12 finishes the reading processing with respect to the paper sheet M is obtained. The time Y is a specific example of a transportation time of the Nth paper sheet until the processing unit (image reading unit 12) finishes the processing with respect to the Nth paper sheet. In addition, the controller 11 determines a specific time Ts which is shorter than the transportation time (time Y) on the basis of the transportation time (Step S260). Specifically, Ts=Y−X.

As described above, according to the description made with reference to FIGS. 3 and 4, the times X and Y are measured according to the transportation operation (transportation operation including reading processing) of the Nth paper sheet M along the transportation path R and the specific time Ts is calculated on the basis of the measurement.

Figure 5:
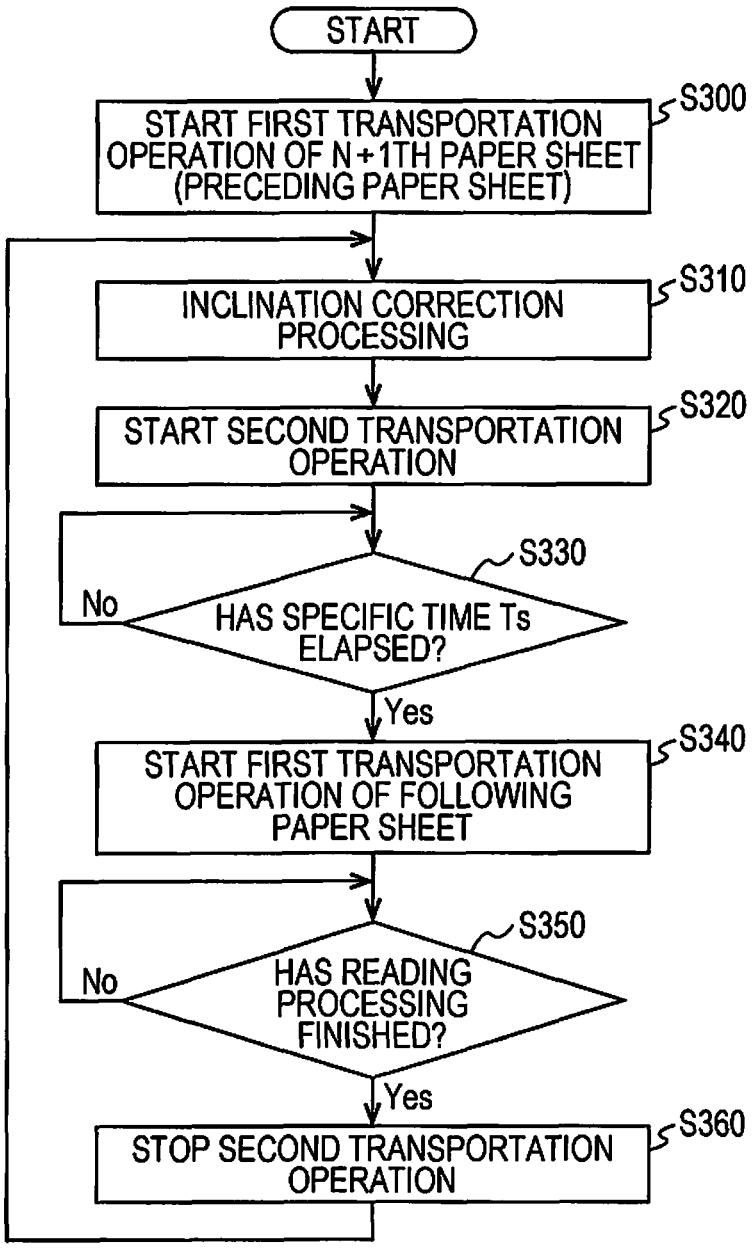
FIG. 5 is a flow chart illustrating transportation processing with respect to (N+1)th and subsequent paper sheets.

FIG. 5 is a flow chart illustrating transportation processing of paper sheets M which is executed subsequent to the transportation processing in FIG. 3, under control of the controller 11.

FIGS. 6A to 7B are views seen from the same direction as FIG. 2 and illustrate the positions of paper sheets for respective timings in the transportation processing of FIG. 5.

Hereinafter, expressions such as a preceding paper sheet M1, a following paper sheet M2, and the like will be used. The preceding paper sheet M1 is the paper sheet M which is transported earlier of two paper sheets M being consecutively transported, and the following paper sheet M2 is the paper sheet M which is transported after the preceding paper sheet M1. Both of the preceding paper sheet M1 and the following paper sheet M2 are included in the (N+1)th and subsequent paper sheets M. That is, the (N+1)th paper sheet M is the preceding paper sheet M1 in any case and the (N+2)th and subsequent paper sheets M are the following paper sheets M2 and the preceding paper sheets M1 at the same time. A paper sheet M which is transported last is the following paper sheet M2. In a case where N=1, the second paper sheet M is the preceding paper sheet M1 and the third paper sheet M is the following paper sheet M2. In addition, when the third paper sheet M is called the preceding paper sheet M1, the fourth paper sheet M is the following paper sheet M2, and similarly, when the fourth paper sheet M is called the preceding paper sheet M1, the fifth paper sheet M is the following paper sheet M2 . . . (hereinafter, this is repeated until the reading processing with respect to the plurality of paper sheets M set on the document tray 25 is ended) and so forth.

The controller 11 starts the first transportation operation of a paper sheet M (preceding paper sheet M1) from the document tray 25 subsequent to Step S140 in FIG. 3 (Step S300). Thereafter, the inclination correction processing is executed (Step S310) and the second transportation operation is started (Step S320).

Figure 6A:
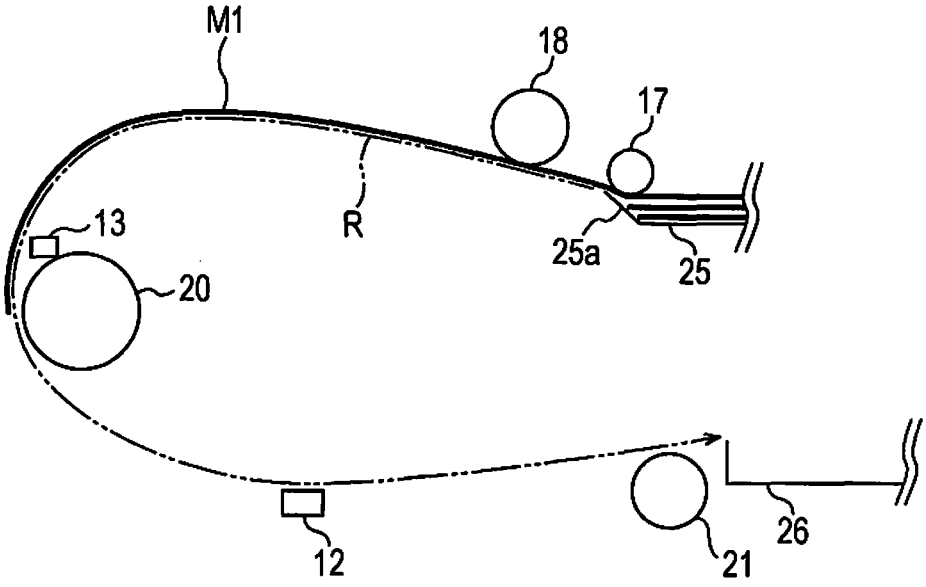
FIGS. 6A and 6B are views illustrating the position of a paper sheet for respective timings in transportation processing.
Figure 6B:
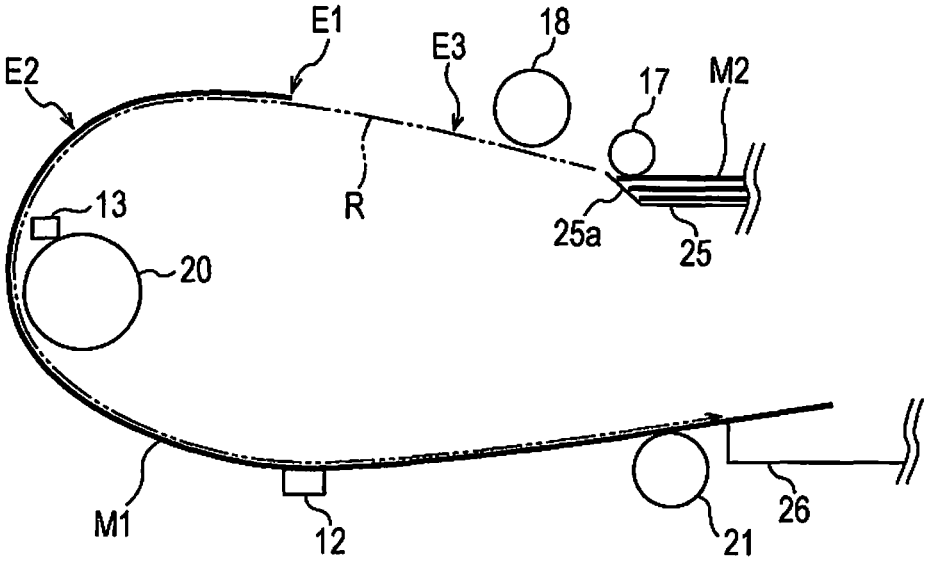

The upper one (FIG. 6A) of FIGS. 6A and 6B illustrates a preceding paper sheet M1 at a time where the second transportation operation (Step S320) is started.

The controller 11 determines whether or not the specific time Ts has elapsed after the second transportation operation is started (Step S330). The specific time Ts is a value determined in Step S260 in FIG. 4. In addition, when the specific time Ts has elapsed after the second transportation operation is started ("Yes" in Step S330), the first transportation operation of the paper sheet M (following paper sheet M2) from the document tray 25 is started (Step S340). That is, in the middle of the second transportation operation of the preceding paper sheet M1, the first transportation operation of the following paper sheet M2 is started.

The lower one (FIG. 6B) of FIGS. 6A and 6B illustrates the preceding paper sheet M1 and the following paper sheet M2 (the following paper sheet M2 at a time where the first transportation operation is started) at a time where the specific time Ts has elapsed after the second transportation operation is started.

After the second transportation operation is started, the controller 11 continuously determines whether the reading processing with respect to the paper sheet M (preceding paper sheet M1) has ended (Step S350). In a case where it is determined that the reading processing has ended ("Yes" in Step S350), the controller 11 stops the second transportation operation (Step S360). Stopping the second transportation operation is stopping the driving of the second motor 19 using the motor driver 15. As a result of this, the paper sheet M having been subject to the reading processing stops at a position in which the paper sheet M is located when the reading processing ends.

If the first transportation operation of the following paper sheet M2 is started at a time when the specific time Ts (Ts=Y−X) has elapsed after the second transportation operation of the preceding paper sheet M1 is started, after the time X has elapsed from that time, the reading processing with respect to the preceding paper sheet M1 ends and a leading end of the following paper sheet M2 is located in a position in which the leading end is detected by the end portion detection sensor 13. That is, a time when the reading processing with respect to the preceding paper sheet M1 ends ("Yes" in Step S350) and the second transportation operation is stopped is the same as a time when the leading end of the following paper sheet M2 reaches the position of the end portion detection sensor 13 as a result of the first transportation operation.

Figure 7A:
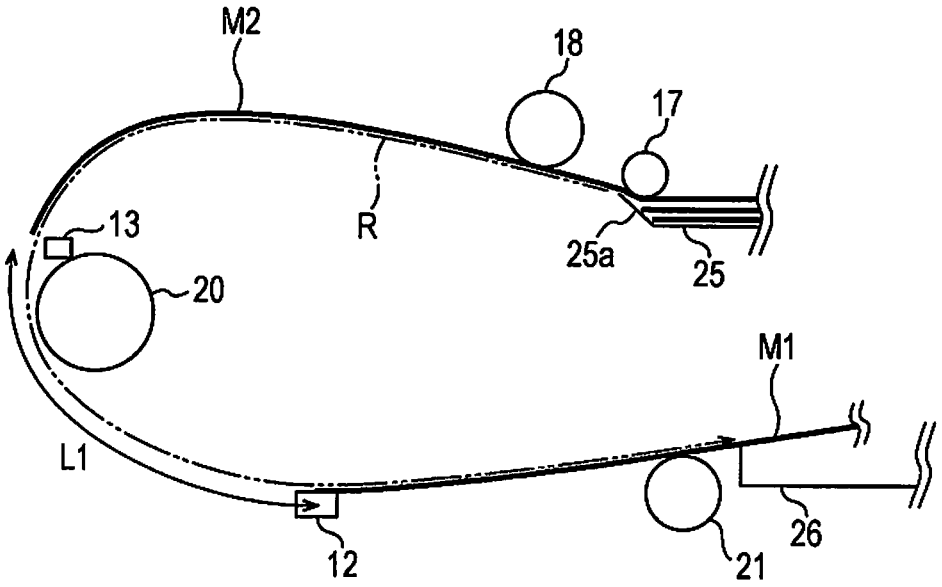
FIGS. 7A and 7B are views illustrating the positions of paper sheets for respective timings in transportation processing.
Figure 7B:
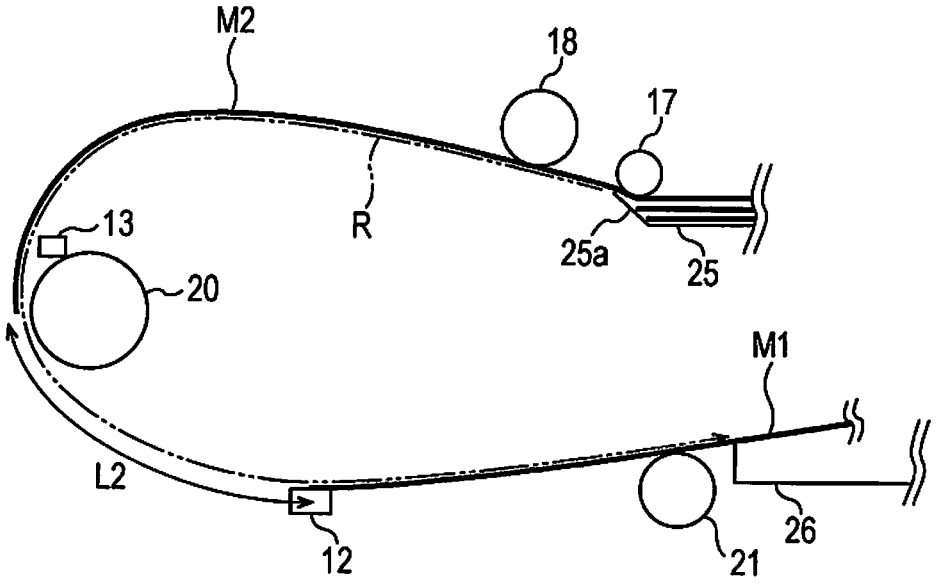

The upper one (FIG. 7A) of FIGS. 7A and 7B illustrates the preceding paper sheet M1 and the following paper sheet M2 at a time where it is determined that the reading processing has ended in Step S350 (Yes). A distance between the leading end of the following paper sheet M2 and the trailing end of the preceding paper sheet M1 shown in FIG. 7A (distance along transportation path R) is one of inter-sheet distances realized by the first embodiment and the distance is substantially equal to a distance L1 between the end portion detection sensor 13 and the image reading unit 12 (distance along transportation path R).

It is needless to say that, after the first transportation operation of the following paper sheet M2 is started, the controller 11 executes the inclination correction processing with respect to the following paper sheet M2 (Step S310). In the inclination correction processing, a leading end of a target paper sheet M needs to be in contact with the PF roller 20 being stopped. In a case where the leading end of the paper sheet M comes into contact with the PF roller 20 rotating, the paper sheet M is transported toward the downstream side without inclination correction. As described above, at the substantially same time as when the leading end of the following paper sheet M2 reaches the position of the end portion detection sensor 13 after the first transportation operation is started in Step S340, the second transportation operation of the preceding paper sheet M1 is stopped (Step S360), that is, the PF roller 20 is stopped. Accordingly, it is needless to say that, when the leading end of the following paper sheet M2 reaches the PF roller 20 passing through the position of the end portion detection sensor 13 as a result of the first transportation operation, the PF roller 20 is in a stationary state. Therefore, the controller 11 can execute the inclination correction processing with respect to the following paper sheet M2 certainly (Step S310). Specifically, when a minute period of time (the time taken for the leading end of the following paper sheet M2 to be moved from the position of the end portion detection sensor 13 to a position in which the leading end comes into contact with the PF roller 20) has elapsed after the reading processing of the preceding paper sheet M1 ends and the second transportation operation is stopped (Step S360), the inclination correction processing with respect to the following paper sheet M2 is executed (Step S310).

The lower one of FIGS. 7A and 7B (FIG. 7B) illustrates the following paper sheet M2 and the preceding paper sheet M1 right after the inclination correction processing with respect to the following paper sheet M2 is executed in Step S310 (Step S310 subsequent to Step S360). The position of the preceding paper sheet M1 is the same for FIGS. 7A and 7B. A distance between the leading end of the following paper sheet M2 and the trailing end of the preceding paper sheet M1 shown in FIG. 7B (distance along transportation path R) is one of inter-sheet distances realized by the first embodiment and the distance is substantially equal to a distance L2 between a contact point between the PF roller 20 and the paper sheet M and the image reading unit 12 (distance along transportation path R).

After the inclination correction processing of the following paper sheet M2 (Step S310), the controller 11 starts the second transportation operation (Step S320). In Step S320 subsequent to Step S360 (or one of Step S440 and Step S520 which are described later) and Step S310, discharging of the preceding paper sheet M1 is started also. That is, when the second transportation operation is started, the second motor 19 is driven and the PF roller 20 and the EJ roller 21 rotate. Therefore, the following paper sheet M2 having been subject to the inclination correction processing is transported by the PF roller 20 so as to be subject to the reading processing performed by the image reading unit 12, and in synchronization with the transportation, the preceding paper sheet M1 being in a stationary state after the reading processing ends is transported and discharged by the EJ roller 21. Through Step S320 subsequent to Steps S360 and S310, a paper sheet M which is the preceding paper sheet M1 so far is discharged and a paper sheet M which is the following paper sheet M2 so far becomes the preceding paper sheet M1.

Although not shown in FIG. 5, in a case where the first transportation operation of the last paper sheet M (following paper sheet M2) in the document tray 25 is started (Step S340), the controller 11 does not execute Steps S330 to S360 of Step S320 and the subsequent steps, the second transportation operation continues until the last paper sheet M is discharged into the discharging tray 26, and the processing ends with the second transportation being stopped. The controller 11 can determine whether or not there is no paper sheet M in the document tray 25 using a known sensor (a sensor only for detecting the absence or presence of a paper sheet) provided in the vicinity of the document tray 25.

Figure 8:
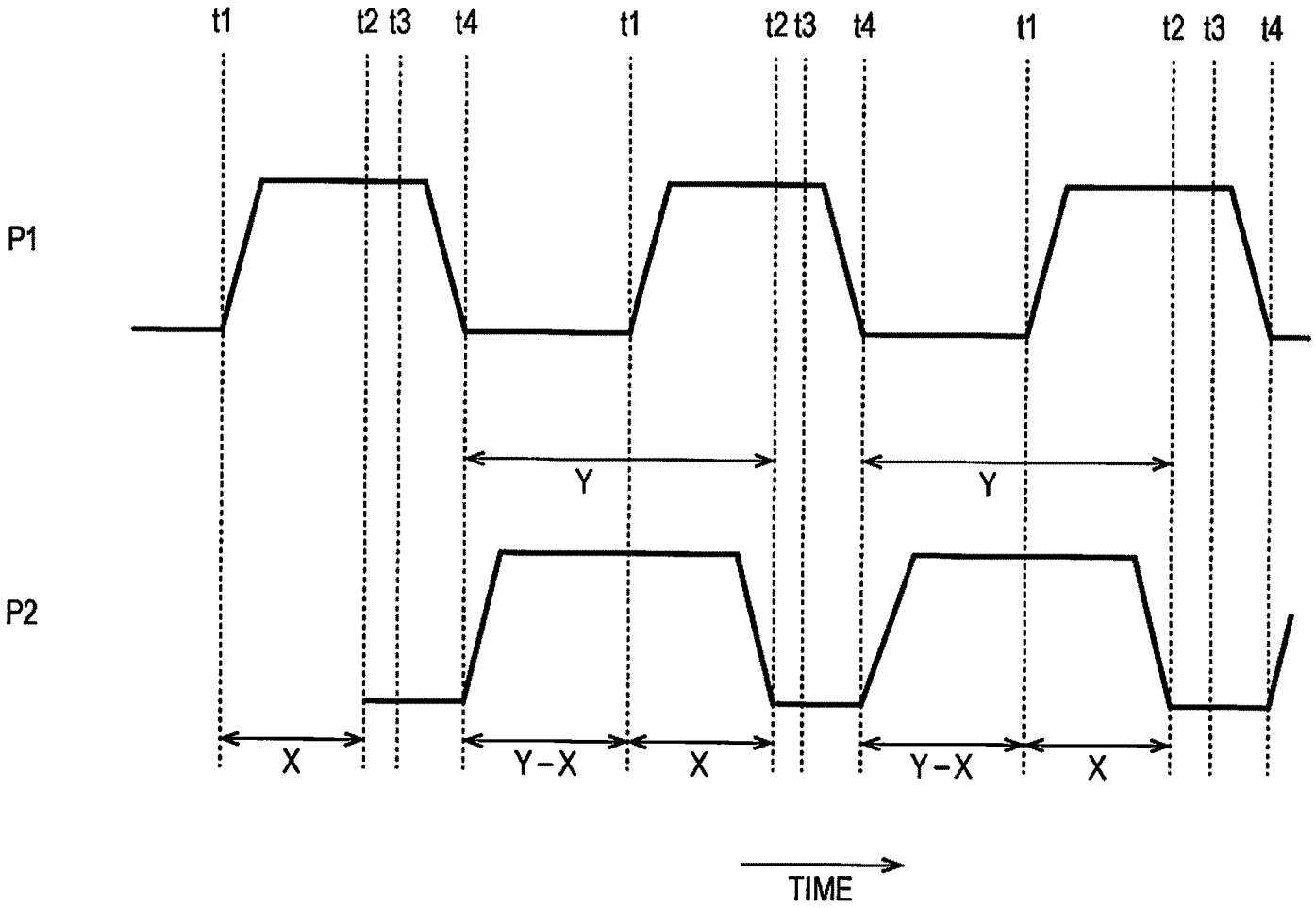
FIG. 8 is a diagram schematically illustrating waveforms of driving signals corresponding to transportation of the (N+1)th and subsequent paper sheets.

FIG. 8 schematically illustrates a waveform P1 of a driving signal that the motor driver 15 transmits to the first motor 16 for the transportation of the (N+1)th and subsequent paper sheets M and a waveform P2 of a driving signal that the motor driver 15 transmits to the second motor 19 for the transportation of the (N+1)th and subsequent paper sheets M. It can be said that the waveform P1 indicates a period in which the PU roller 17 and the separation roller 18 rotate and the waveform P2 indicates a period in which the PF roller 20 and the EJ roller 21 rotate. According to FIG. 8, timing t1 at which the waveform P1 rises up corresponds to Step S300 or Step S340 (start of first transportation operation) in FIG. 5 and timing t2 which is a time after the time X has elapsed from the timing t1 corresponds to a time at which a leading end of a paper sheet M in the middle of the first transportation operation is detected by the end portion detection sensor 13 (and a time at which the reading processing ends and the second transportation operation is stopped).

Timing t3, which is a time after a minute period of time has elapsed from the timing t2, corresponds to timing of the start of Step S310 (inclination correction processing). In addition, timing t4 at which the waveform P1 falls down and the waveform P2 rises up corresponds to Step S320 (start of second transportation operation) and after the specific time Ts (=Y−X) has elapsed from the timing t4, the waveform P1 rises up again (timing t1).

According to the above-described transportation processing (FIGS. 5 to 8), the (N+1)th and subsequent paper sheets M (a plurality of paper sheets M) can be consecutively transported with the inter-sheet distance between the preceding paper sheet M1 and the following paper sheet M2 being reduced to a distance, for example, the distance L1 or the distance L2. As described above, the inclination correction processing cannot be executed when the PF roller 20 rotates. Meanwhile, the rotation of the PF roller 20, that is, the second transportation operation, cannot be stopped until the reading processing with respect to the preceding paper sheet M1 ends. This is because read data generated by the image reading unit 12 is damaged if the second transportation operation is stopped in the middle of the reading processing. Therefore, there is a restriction that the inclination correction processing with respect to the following paper sheet M2 cannot be executed unless the reading processing with respect to the preceding paper sheet M1 ends. When considering such a restriction, it can be said that, before the inclination correction processing with respect to the following paper sheet M2 is executed, a state where the inter-sheet distance is L1 as shown in FIG. 7A, that is, a state where the following paper sheet M2 is located right before the PF roller 20 at a time when the reading processing with respect to the preceding paper sheet M1 has ended, is a state where the substantially shortest inter-sheet distance has been achieved. In addition, it can be said that, after the inclination correction processing with respect to the following paper sheet M2 is executed, a state where the inter-sheet distance is L2 as shown in FIG. 7B is a state where the substantially shortest inter-sheet distance has been achieved.

As described above, according to the first embodiment, in the transportation apparatus (reading apparatus 10), the controller 11 measures the transportation time (time Y) of the Nth paper sheet M (N is an integer of 1 or more) until the processing unit (image reading unit 12) finishes the processing with respect to the Nth paper sheet M, and determines the specific time Ts which is shorter than the transportation time on the basis of the transportation time. Then, the controller 11 causes the first transportation unit 22 to start transportation of the next paper sheet M (following paper sheet M2) from the document tray 25 at a time when the specific time Ts has elapsed after the second transportation unit 23 starts to transport the paper sheet M (preceding paper sheet M1) in a case where the second transportation unit 23 transports the (N+1)th and subsequent paper sheets. Accordingly, in the transportation of the (N+1)th and subsequent paper sheets M, the transportation of the next paper sheet M is started before the processing unit (image reading unit 12) finishes the processing with respect to the paper sheet M (decrease in inter-sheet distance), and thus the transportation becomes efficient and the throughput of the transportation apparatus (reading apparatus 10) is increased. In addition, the above-described effects can be achieved without adding a dedicated sensor (a dedicated sensor other than the end portion detection sensor 13 which is used in the related art) or the like in the middle of the transportation path R.

As described above, when specific time Ts=Y−X, the shortest inter-sheet distance can be achieved. However, since the specific time Ts is shorter than the time Y, for example, a time which is longer than Y−X and is shorter than Y can be used as the specific time Ts.

The controller 11 executes the measurement processing in FIG. 4 and the transportation processing in FIG. 3 (transportation processing with respect to Nth paper sheet M) in parallel. However, the transportation processing with respect to the (N+1)th and subsequent paper sheets M, which is shown in FIG. 5, also can be executed in parallel with the measurement processing. That is, the controller 11 measures and updates the time X each time when the first transportation unit 22 performs the first transportation operation of the paper sheet M and measures and updates the time Y each time when the second transportation unit 23 performs the second transportation operation of the paper sheet M. Specifically, when the first transportation unit 22 starts the first transportation operation of the paper sheet M from the document tray 25 (Steps S300 and S340 in FIG. 5), the controller 11 measures the time X (Steps S200 to S220 in FIG. 4) and updates the currently stored time X with the time X acquired in the latest measurement. Similarly, when the second transportation unit 23 starts the second transportation operation of the paper sheet M (Step S320 in FIG. 5), the controller 11 measures the time Y (Steps S230 to S250 in FIG. 4) and updates the currently stored time Y with the time Y acquired in the latest measurement.

Since the measurement processing is executed in association with the transportation processing with respect to the paper sheet M, the controller 11 can determine the timing of the start of the first transportation operation of the following paper sheet M2 using the specific time Ts which is obtained on the basis of more recent times X and Y (Step S330 in FIG. 5). For example, after the transportation processing with respect to the paper sheet M is started with an instruction to start the document reading operation being issued, the timing of the start of the first transportation operation of a twentieth paper sheet M from the document tray 25 can be determined using the specific time Ts which is obtained on the basis of the time Y that is measured during the second transportation operation of an eighteenth paper sheet M and the time X that is measured during the first transportation operation of a nineteenth paper sheet M.

Since the transportation distance is slightly different for each paper sheet M, updating the time X for each first transportation operation of the paper sheet M is very useful. In FIG. 2, an inclined surface 25*a* sloping upward toward the separation roller 18 side is formed on the document tray 25. The document tray 25 accommodates the plurality of paper sheets M with the leading ends of the paper sheets M being in contact with the inclined surface 25*a*. Accordingly, regarding the plurality of paper sheets M accommodated in the document tray 25, the later a paper sheet M is subject to the first transportation operation, the longer the distance between the end portion detection sensor 13 and the paper sheet M is. Accordingly, a time (time X) taken from when a paper sheet M is drawn into the transportation path R with the PU roller 17 starting to rotate to when a leading end is detected by the end portion detection sensor 13 is different for each paper sheet M and with reference to FIG. 2, the time X increases as the ordinal number of the first transportation operation increases. In this state, since the specific time Ts is calculated on the basis of the time X which is updated for each first transportation operation of the paper sheet M, the controller 11 can gradually change (gradually advance) the time at which the first transportation operation of the following paper sheet M2 is started after the second transportation operation of the preceding paper sheet M1 is started. Accordingly, regardless of the ordinal number of the paper sheet M, it is possible to maintain the inter-sheet distance of L1 for a time when the reading processing with respect to the preceding paper sheet M1 ends, and the transportation efficiency is not lowered.

The invention is not limited to the embodiments above, and may be implemented in various forms without departing from the gist thereof. For example, the following embodiments and modifications are also possible. An appropriate combination of a plurality of embodiments and modification examples can also be included in the scope of the present application. Hereinafter, the same matters as in the above description will not be described repeatedly.

3. Second Embodiment

A second embodiment has been made considering that paper sheets M, which are different in length (length in transportation direction), may be set in the document tray 25.

Figure 9:
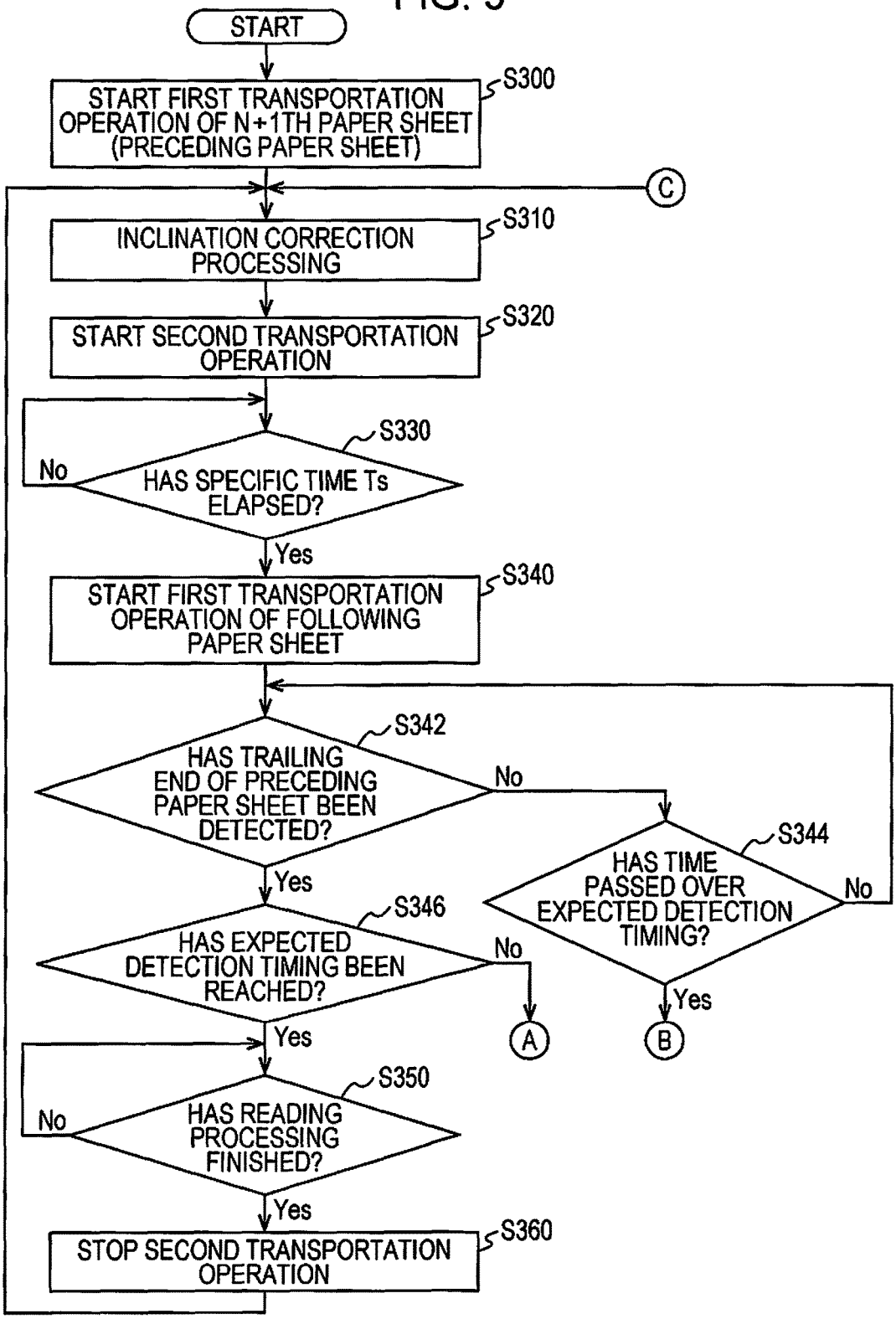
FIG. 9 is a flow chart illustrating a portion of transportation processing with respect to (N+1)th and subsequent paper sheets according to a second embodiment.

FIG. 9 is a flow chart illustrating the transportation processing with respect to the (N+1)th and subsequent paper sheets M which is executed subsequent to the transportation processing in FIG. 3 (transportation processing with respect to the Nth paper sheet M) under control of the controller 11. When comparing FIG. 9 with FIG. 5, it is understood that FIG. 9 includes additional Steps S342, S344, and S346.

After the first transportation operation of the paper sheet M (following paper sheet M2) from the document tray 25 is started in Step S340, the controller 11 determines whether the trailing end of the preceding paper sheet M1, that is, the trailing end of the paper sheet M in the middle of the current second transportation operation, is detected by the end portion detection sensor 13 (Step S342). When a detection signal indicating that the trailing end of the paper sheet M is detected is input from the end portion detection sensor 13, the controller 11 determines "Yes" in Step S342, and proceeds to determination in Step S346. Meanwhile, the controller 11 determines "No" in Step S342 until the detection signal indicating that the trailing end is detected is input, and proceeds to determination in Step S344.

In Step S344, the controller 11 determines whether the time has passed over a time (expected detection timing) at which the trailing end of the paper sheet M is detected by the end portion detection sensor 13, the time being expected from the paper sheet length Lm. The time sheet length Lm is the length in the transportation direction of the paper sheet M which is calculated in advance by the controller 11 on the basis of the second transportation operation of the paper sheet M performed by the second transportation unit 23. The controller 11 stores the time Y in Step S250 of the measurement processing (FIG. 4). Although not particularly described in the first embodiment, in Step S250, the controller 11 calculates the paper sheet length Lm on the basis of the time Y and stores the paper sheet length Lm along with the time Y.

The controller 11 can calculate the paper sheet length Lm by obtaining the distance, by which the paper sheet M is transported within the time Y due to the second transportation operation, from the time Y and a predetermined rotation rate (rotation rate of the second motor 19) and subtracting the distance L2 (refer to FIG. 7B) from the obtained distance. As described above, since the controller 11 executes the measurement processing (FIG. 4) each time the paper sheet M is transported, a new paper sheet length Lm is stored (updated) along with the time Y each time the second transportation operation of the paper sheet M is performed. Accordingly, the paper sheet length Lm used by the controller 11 in Step S344 (or Step S346 described later) is the latest paper sheet length Lm, that is the length of the paper sheet M which has been subject to the second transportation operation (reading processing thereof is already finished) right before the paper sheet M which is in the middle of the current second transportation operation.

The controller 11 subtracts the distance (distance along the transportation path R) between the position of the end portion detection sensor 13 and the contact point between the PF roller 20 and the paper sheet M, which is a fixed value, from the paper sheet length Lm. In this way, it is possible to calculate the length of a portion of the paper sheet M which is on the upstream side of the end portion detection sensor 13 at a time when the second transportation operation is started (Step S320) (expected trailing end side partial length). Then, since a time taken from when the second transportation of the paper sheet M is started to when the trailing end of the paper sheet M reaches the end portion detection sensor 13 can be obtained from the expected trailing end side partial length and the predetermined rotation rate (rotation rate of the second motor 19), the time is used as the expected detection timing.

Figure 11:
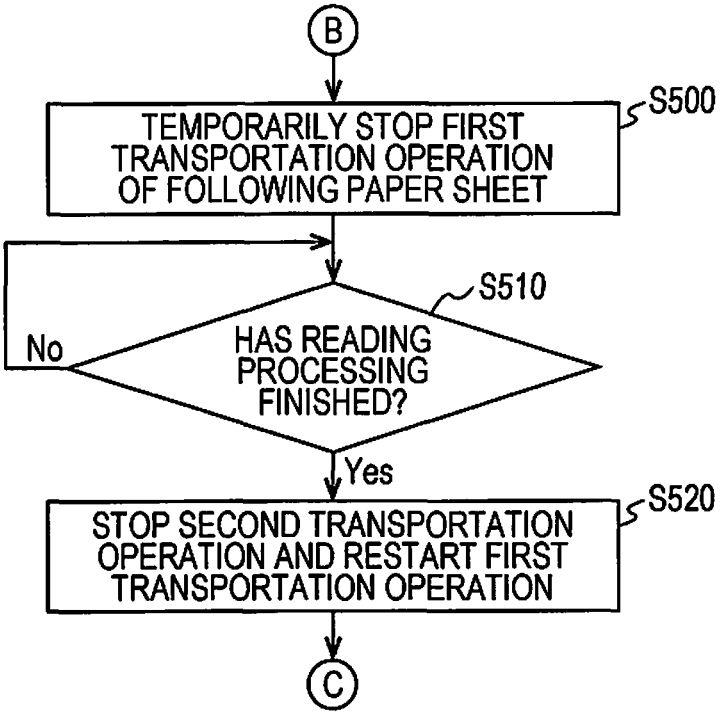
FIG. 11 is a flow chart illustrating a portion of the transportation processing with respect to (N+1)th and subsequent paper sheets according to the second embodiment.

In Step S344, in a case where the time has elapsed after the second transportation operation of the paper sheet M is started in Step S320 and has passed over the expected detection timing, the controller 11 determines "Yes" and proceeds to Step S500 (FIG. 11). Meanwhile, in a case where the time has not passed over the expected detection timing, the controller 11 determines "No" and returns to determination in Step S342. As described above, in a case where the trailing end of the paper sheet M in the middle of the current second transportation operation is not detected by the end portion detection sensor 13 ("No" in Step S342) and the time has passed over the expected detection timing ("Yes" in Step S344), it means that the length of the paper sheet M in the middle of the current second transportation operation is larger than the length of the paper sheet M having been subject to the immediately previous second transportation operation.

Figure 10:
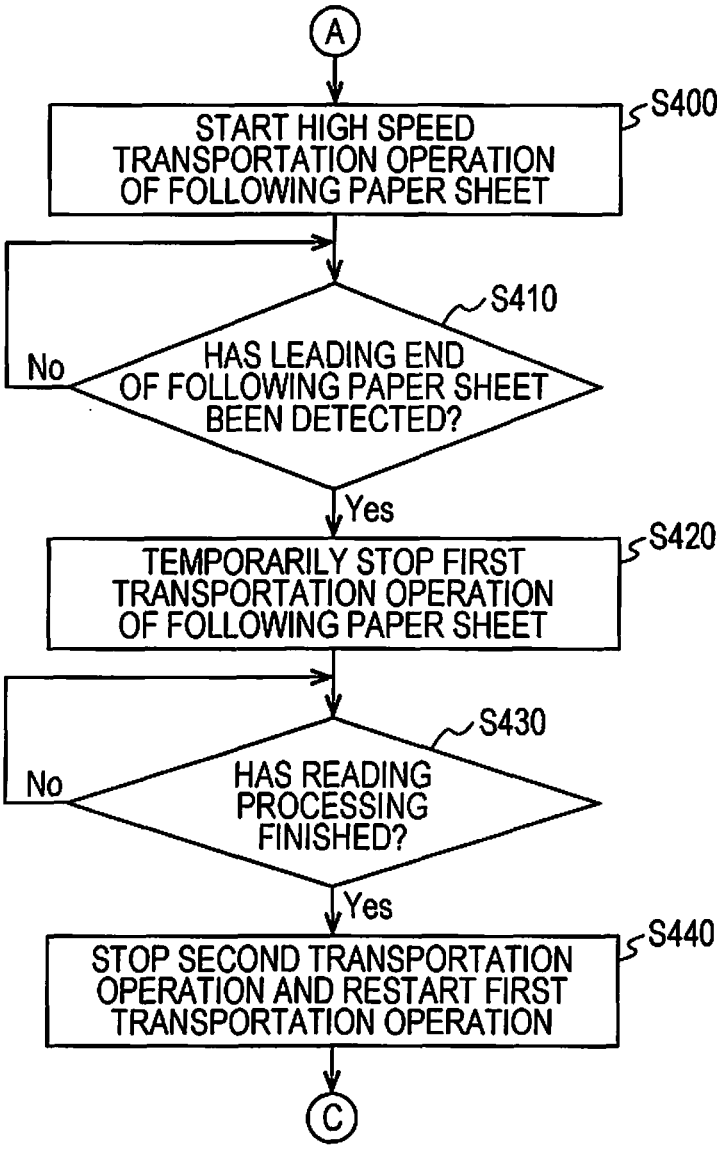
FIG. 10 is a flow chart illustrating a portion of the transportation processing with respect to (N+1)th and subsequent paper sheets according to the second embodiment.

In Step S346, the controller 11 determines whether the time has elapsed after the second transportation operation of the paper sheet M is started in Step S320 and the expected detection timing has been reached, and when the expected detection timing is reached, the controller 11 determines "Yes" and proceeds to Step S350. Meanwhile, when the expected detection timing is not reached, the controller 11 determines "No" and proceeds to Step S400 (FIG. 10). In a case where the trailing end of the paper sheet M in the middle of the current second transportation operation is detected by the end portion detection sensor 13 ("Yes" in Step S342) and the expected detection timing is reached ("Yes" in Step S346), it means that the length of the paper sheet M in the middle of the current second transportation operation is equal to the length of the paper sheet M having been subject to the immediately previous second transportation operation. In a case where paper sheets M which are the same in length are sequentially transported as described above, above-described Step S350 and subsequent steps are executed. Meanwhile, in a case where the trailing end of the paper sheet M in the middle of the current second transportation operation is detected by the end portion detection sensor 13 ("Yes" in Step S342) and the expected detection timing is not reached ("No" in Step S346), it means that the length of the paper sheet M in the middle of the current second transportation operation is smaller than the length of the paper sheet M having been subject to the immediately previous second transportation operation.

As shown in FIG. 10, the controller 11 starts a high speed transportation operation in which the speed of the transportation operation of the following paper sheet M2 performed by the first transportation unit 22 is increased (Step S400). In the second embodiment, respective predetermined rotation rates are determined as rotation rates of the first motor 16 and the second motor 19, and in a normal state, the first motor 16 and the second motor 19 are operated using the predetermined rotation rates. Step S400 is an exception in terms of the predetermined rotation rates and in Step S400, the first motor 16 of the first transportation unit 22 rotates at a rate higher than the predetermined rotation rate which is used in a normal operation state and realizes the high speed transportation operation.

After the high speed transportation operation is started, the controller 11 determines whether the leading end of the following paper sheet M2 in the middle of the high speed transportation operation is detected by the end portion detection sensor 13 (Step S410). When the detection signal indicating that the leading end of the paper sheet M is detected is input from the end portion detection sensor 13, the controller 11 determines "Yes" in Step S410 and proceeds to Step S420. In Step S420, the controller 11 temporarily stops the first transportation operation. Due to the temporary stoppage, the following paper sheet M2 in the middle of the high speed transportation operation is stopped before the leading end thereof comes into contact with the PF roller 20.

Furthermore, the controller 11 determines whether the reading processing with respect to the paper sheet M (preceding paper sheet M1) in the middle of the second transportation operation has ended (Step S430). In a case where it is determined that the reading processing has ended ("Yes" in Step S430), the controller 11 stops the second transportation operation and restarts the first transportation operation (Step S440). Step S430 is the same as Steps S130 and S350.

With Step S420 (temporary stoppage of first transportation operation) and Step S440 (restart of first transportation operation), it is possible to prevent the leading end of the following paper sheet M2 coming into contact with the PF roller 20 in the middle of the second transportation operation, that is, the PF roller 20 rotating, and to quickly proceed to the inclination correction processing (Step S310 in FIG. 9) with respect to the following paper sheet M2 after the reading processing with respect to the preceding paper sheet M1 ends.

FIG. 6B illustrates a trailing end E1 of the preceding paper sheet M1. The trailing end E1 is a trailing end in a case where the length of the preceding paper sheet M1 shown in FIG. 6B is the same as the paper sheet length Lm of the paper sheet M having been subject to the immediately previous reading processing. That is, if the paper sheets M are the same in length, when the first transportation operation of the following paper sheet M2 is started after the specific time Ts has elapsed from the start of the second transportation of the preceding paper sheet M1, the distance between the leading end of the following paper sheet M2 and the trailing end E1 is secured as the inter-sheet distance. Meanwhile, FIG. 6B illustrates a trailing end E2 also. It is assumed that the trailing end E2 is a trailing end in a case where the length of the preceding paper sheet M1 shown in FIG. 6B is smaller than the paper sheet length Lm of the paper sheet M having been subject to the immediately previous reading processing. In a case where the second transportation operation of the paper sheet M which is shorter than the paper sheet M having been subject to the reading processing is started, when the first transportation operation of the following paper sheet M2 is started after the specific time Ts has elapsed from the start of the second transportation operation, the distance between the leading end of the following paper sheet M2 and the trailing end E2, which is long, becomes the inter-sheet distance.

For a problem of the long inter-sheet distance as described above, above-described Step S342, Step S346, Step S400, and the subsequent steps (FIGS. 9 and 10) provide a remedy. That is, the controller 11 performs the high speed transportation operation which speeds up the transportation of the paper sheet M (following paper sheet M2) which is performed by the first transportation unit 22 in a case where a time at which the trailing end of the paper sheet M (preceding paper sheet M1) which the second transportation unit 23 starts to transport is detected by the end portion detection sensor 13 is earlier than timing of the detection expected from the calculated paper sheet length Lm. With such a high speed transportation operation, the inter-sheet distance corresponding to the distance between the leading end of the following paper sheet M2 and the trailing end E2 shown in FIG. 6B is immediately reduced and it is possible to avoid a decrease in transportation efficiency.

As shown in FIG. 11, the controller 11 temporarily stops the first transportation operation of the following paper sheet M2 performed by the first transportation unit 22 (Step S500). Next, the controller 11 determines whether the reading processing with respect to the preceding paper sheet M1 in the middle of the second transportation operation has ended (Step S510). In a case where it is determined that the reading processing has ended ("Yes" in Step S510), the controller 11 stops the second transportation operation and restarts the first transportation operation (Step S520). Step S510 is the same as Steps S130 and S350.

FIG. 6B illustrates a trailing end E3 along with the trailing ends E1 and E2. It is assumed that the trailing end E3 is a trailing end in a case where the length of the preceding paper sheet M1 shown in FIG. 6B is larger than the paper sheet length Lm of the paper sheet M having been subject to the immediately previous reading processing. In a case where the second transportation operation of the paper sheet M which is longer than the paper sheet M having been subject to the reading processing is started, when the first transportation operation of the following paper sheet M2 is started after the specific time Ts has elapsed from the start of the second transportation operation, the distance between the leading end of the following paper sheet M2 and the trailing end E3, which is very short, becomes the inter-sheet distance.

If the inter-sheet distance is short as described above, the trailing end of the preceding paper sheet M1 is likely to come into contact with the leading end of the following paper sheet M2, which may cause a paper jam. In addition, there is a possibility of the leading end of the following paper sheet M2 reaching the PF roller 20 before the reading processing with respect to the preceding paper sheet M1 ends. For such a problem, above-described Step S342, Step S344, Step S500 and the subsequent steps (FIGS. 9 and 11) provide a remedy. That is, the transportation of the paper sheet M (following paper sheet M2) which is performed by the first transportation unit 22 is temporarily stopped in a case where the time at which the trailing end of the paper sheet M (preceding paper sheet M1) which the second transportation unit 23 starts to transport is detected by the end portion detection sensor 13 is later than the expected detection timing which is expected from the calculated paper sheet length Lm (in a case where it can be determined that the time is later than the expected detection timing). With the temporary stoppage, the inter-sheet distance is increased and it is possible to avoid a paper jam and to avoid that the following paper sheet M2 reaches the PF roller 20 excessively early. In addition, with Step S520 (restart of first transportation operation), it is possible to quickly proceed to the inclination correction processing (Step S310 in FIG. 9) with respect to the following paper sheet M2 after the reading processing with respect to the preceding paper sheet M1 ends.

Even in a case where the processing in FIG. 10 or FIG. 11 is executed, the controller 11 executes the measurement processing (FIG. 4). That is, in a case where the controller 11 proceeds to Step S400 from the determination in Step S346 after the second transportation operation is started in Step S320 (FIG. 9), the controller 11 stores a time taken for the controller 11 to determine "Yes" in S430 as the latest time Y, and stores a paper sheet length Lm based on the time Y as the latest paper sheet length Lm (Steps S230 to S250 in FIG. 4). Similarly, in a case where the controller 11 proceeds to Step S500 from the determination in Step S344 after the second transportation operation is started in Step S320 (FIG. 9), the controller 11 stores a time taken for the controller 11 to determine "Yes" in S510 as the latest time Y, and stores a paper sheet length Lm based on the time Y as the latest paper sheet length Lm (Steps S230 to S250 in FIG. 4).

With this configuration, after the second transportation operation of the paper sheet M of which the length is larger or smaller than the paper sheet length Lm of the paper sheet M having been subject to the immediately previous reading processing (after the reading processing ends), it is possible to determine the time at which the next first transportation operation is started on the basis of the time Y corresponding to the long or short paper sheet M. In addition, after the second transportation operation of the paper sheet M of which the length is larger or smaller than the paper sheet length Lm of the paper sheet M having been subject to the immediately previous reading processing (after the reading processing ends), it is possible to determine whether the paper sheet M to be subject to the next second transportation operation is long or short on the basis of the paper sheet length Lm of the long or short paper sheet M.

Note that, in a case where the processing in FIG. 10 or FIG. 11 is executed, the controller 11 does not measure the time X. That is, in a case where the controller 11 proceeds to Step S400 and the subsequent steps from the determination in Step S346 after the first transportation operation is started in Step S340 (FIG. 9) (after measurement of the time X is started), the controller 11 stops the measurement of the time X at a time when the first transportation operation is changed to the high speed transportation operation, and cancels the measurement result. Similarly, in a case where the controller 11 proceeds to Step S500 and the subsequent steps from the determination in Step S344 after the first transportation operation is started in Step S340 (FIG. 9) (after measurement of the time X is started), the controller 11 stops the measurement of the time X at a time when the first transportation operation is temporarily stopped, and cancels the measurement result.

In a case where the first transportation operation is changed to the high speed transportation operation or is temporarily stopped, the time X taken for the leading end of the paper sheet M in the middle of the first transportation operation is detected by the end portion detection sensor 13 may be significantly different from expected time X. If the time X which is significantly different from the expected time X is stored as the latest time X, the specific time Ts which is calculated from the times X and Y may be an inappropriate value. Therefore, in the processing shown in FIG. 10 or FIG. 11, the time X is not measured. The measurement processing (FIG. 4) is executed in parallel as usual in Steps S346 to S350 in the flowchart of FIG. 9, and thus it is needless to say that there is no significant influence even if the update of time X is temporarily stopped due to the controller 11 proceeding to the processing in FIG. 10 or FIG. 11 from the flowchart.

The trailing end E3 in FIG. 6B indicates a state where there is an inter-sheet distance between the trailing end E3 and the leading end of the following paper sheet M2 although the inter-sheet distance is short. However, there may be a preceding paper sheet M1 of which the length is long to such an extent that the vicinity of the trailing end of the preceding paper sheet M1 is in contact with the separation roller 18 or the PU roller 17 even when the specific time Ts has elapsed after the second transportation operation of the preceding paper sheet M1 is started. It is needless to say that the first transportation operation of the following paper sheet M2 is temporarily stopped in Step S500 (FIG. 11) in a case where the preceding paper sheet M1 is very long as described above. When considering a possibility of the vicinity of the trailing end of the preceding paper sheet M1 being in contact with the separation roller 18 or the PU roller 17 even at the time of Step S500, a component for transporting the paper sheet M being in contact with the separation roller 18 or the PU roller 17 using the second transportation unit 23 is needed.

As an example of such a component, the first transportation unit 22 may include an one-way clutch that transmits a rotational force only in a direction along which the paper sheet M is fed being positioned on the downstream side of the first transportation unit 22. In the first transportation unit 22, the one-way clutch is disposed between the first motor 16 and the rollers 17 and 18. Accordingly, when the first motor 16 is driven, the rollers 17 and 18 rotate in a direction in which the paper sheet M is transported toward the downstream side. Meanwhile, when the first motor 16 is not driven, that is, when the first transportation operation is stopped, the rollers 17 and 18 can rotate idle. According to this configuration, even when the vicinity of the trailing end of the preceding paper sheet M1 is in contact with the separation roller 18 or the PU roller 17 at the time of Step S500, it is possible to transport the preceding paper sheet M1 using the second transportation unit 23.

4. Third Embodiment

In a third embodiment, it is assumed that the processing unit (image reading unit 12) executes processing (both-surface processing) with respect to the both surfaces of the paper sheet M. The controller 11 causes the image reading unit 12 to execute the reading processing with respect to a first surface (front surface) of the paper sheet M and then causes the image reading unit 12 to execute the reading processing with respect to a second surface (rear surface) of the paper sheet M, which is on the rear side of the first surface, after reversing the paper sheet M. In the transportation processing with respect to the paper sheet M for the both-surface processing, after a transportation operation for the second surface, which will be described later, is started with respect to the preceding paper sheet M1, before the reading processing with respect to the second surface of the preceding paper sheet M1 ends, the controller 11 can start the first transportation operation of the following paper sheet M2 at a time as described above. Alternatively, in the transportation processing with respect to the paper sheet M for the both-surface processing, as an exception of the first and second embodiments, the controller 11 may start the first transportation operation of the following paper sheet M after the reading processing with respect to the second surface of one paper sheet M ends.

Figure 12A:
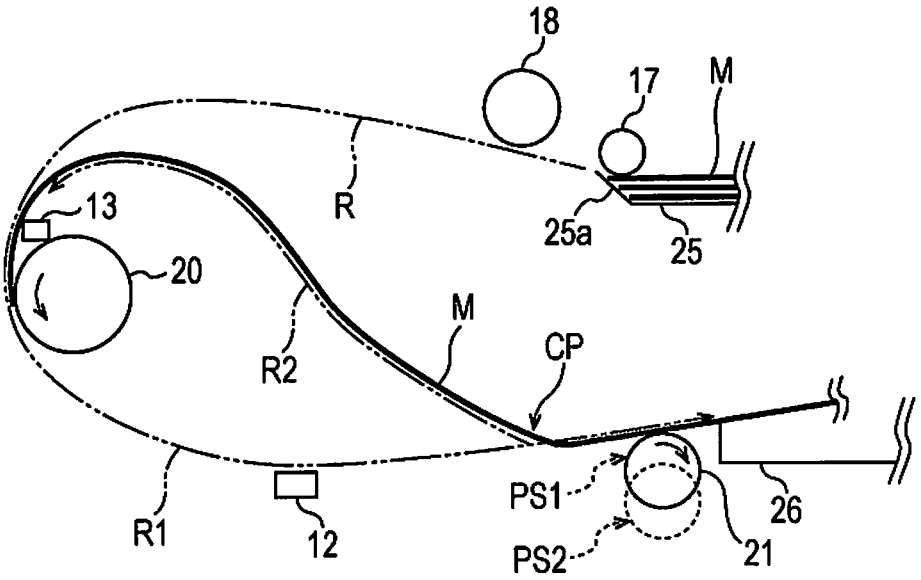
FIGS. 12A and 12B are views schematically illustrating a configuration including a paper sheet transportation path according to a third embodiment.
Figure 12B:
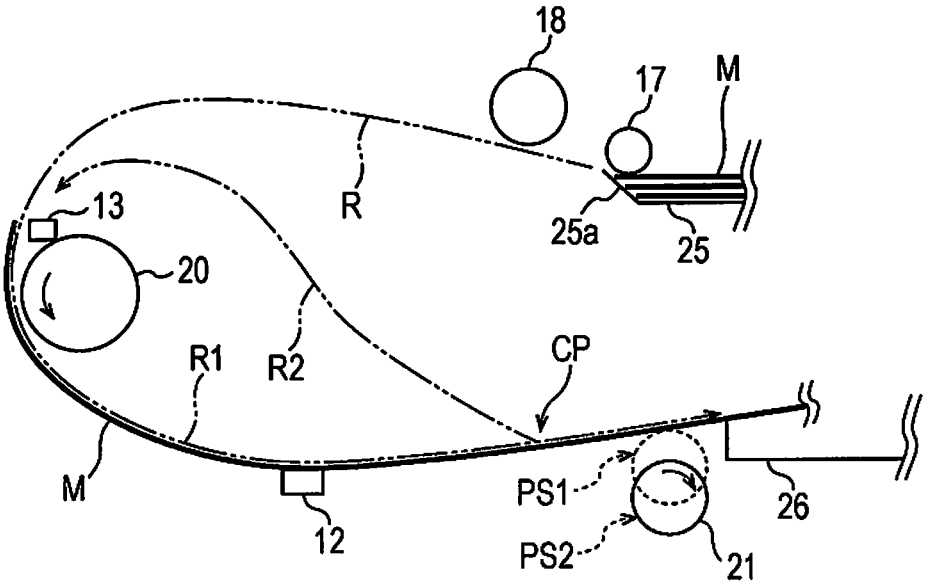

FIGS. 12A and 12B are views as seen from the same direction as FIG. 2 and schematically illustrate a configuration including the transportation path R of the paper sheet M according to the third embodiment. In addition, FIGS. 12A and 12B illustrate the position of the paper sheet M for respective timings in the third embodiment. The configuration in FIGS. 12A and 12B is different from that in FIG. 2 in that a second transportation path R2 which is a path for reversing the paper sheet M is provided. In addition, FIGS. 12A and 12B illustrate a first transportation path R1. The first transportation path R1 is a portion of the transportation path R and is a path along which the paper sheet M is transported from the PF roller 20 to the EJ roller 21 passing through the image reading unit 12, substantially. The second transportation path R2 is a path along which the paper sheet M is returned from the EJ roller 21 to the PF roller 20 without passing through the image reading unit 12, substantially.

When the controller 11 receives settings of the both-surface processing via the operation input unit 24 or the like and receives an instruction to start the document reading operation from the document tray 25, the controller 11 starts both-surface processing control. At this time, main processing, such as the first transportation operation of the paper sheet M from the document tray 25, which is performed by the first transportation unit 22, the inclination correction processing of the paper sheet M, and the second transportation operation of the paper sheet M, which is performed by the second transportation unit 23 after the inclination correction processing, is executed in the same manner as in the above-described embodiments. Since the third embodiment is featured by the second transportation operation performed by the second transportation unit 23, the second transportation operation will be described below.

Figure 13:
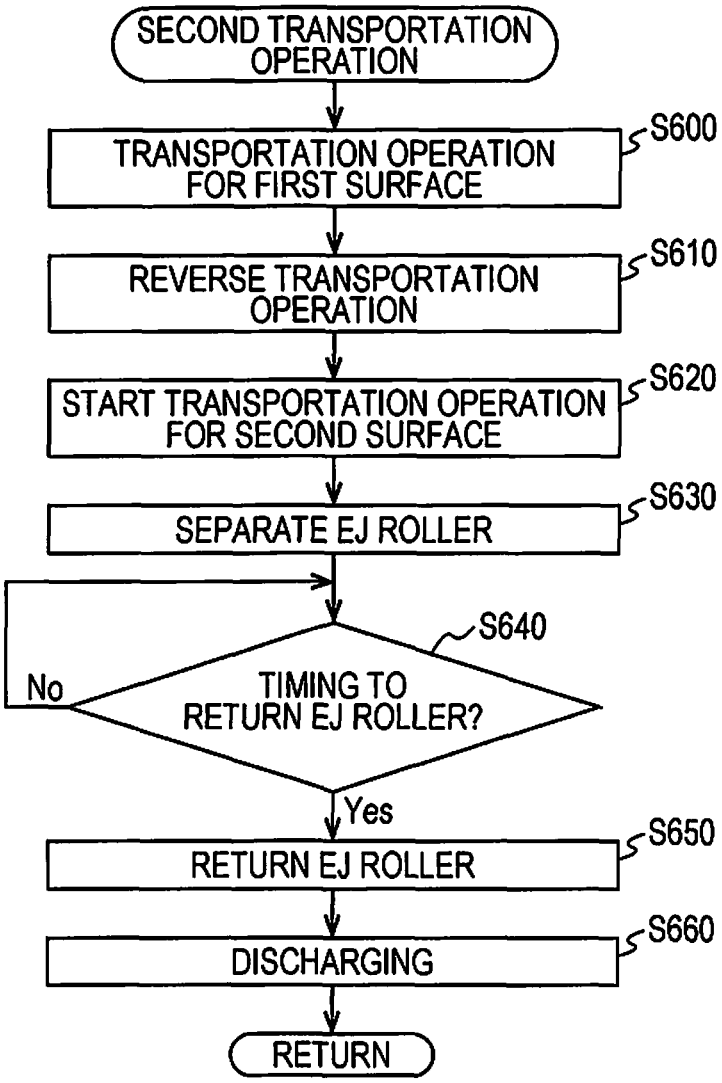
FIG. 13 is a flow chart illustrating a second transportation operation according to the third embodiment.

FIG. 13 is a flow chart illustrating the second transportation operation in the third embodiment. When controlling the second transportation operation, first, the controller 11 drives (forward rotation driving) the second motor 19 using the motor driver 15 to cause the PF roller 20 and the EJ roller 21 to rotate (forward rotation) so that a target paper sheet M is transported along the transportation path R (mainly, first transportation path R1) until the trailing end thereof reaches a predetermined position on the downstream side of a branching position CP (Step S600). In FIGS. 12A and 12B, arrows, which indicate respective forward rotation directions of the rollers 20 and 21, are provided in the rollers 20 and 21 for reference. Step S600 is called a transportation operation for the first surface. The branching position CP is a position at which the transportation path R diverges into the first transportation path R1 and the second transportation path R2 as seen from the downstream side and is located on the downstream side of the image reading unit 12 and the upstream side of the EJ roller 21. In the middle of the transportation operation for the first surface, the image reading unit 12 finishes the reading processing with respect to one of the both surfaces of the paper sheet M that faces the image reading unit 12 side (first surface).

Next, the controller 11 performs a reverse transportation operation (Step S610) by performing reverse rotation driving of the second motor 19. When the second motor 19 is subject to the reverse rotation driving, each of the PF roller 20 and the EJ roller 21 is rotated in a direction opposite to the forward rotation direction. As a result of the reverse transportation operation, the paper sheet M having been subject to the transportation operation for the first surface is moved toward the upstream side by the EJ roller 21 rotating and enters the second transportation path R2 via the branching position CP. On the opposite side to the EJ roller 21 side, the second transportation path R2 joins the transportation path R at a position on the upstream side of the end portion detection sensor 13. Accordingly, as a result of the reverse transportation operation, the trailing end of the paper sheet M reaches a position on the upstream side of the end portion detection sensor 13 in the transportation path R. When the paper sheet M returns to the transportation path R, the trailing end of the paper sheet M becomes the leading end of the paper sheet M. That is, as a result of the reverse transportation operation, the leading end of the paper sheet M so far becomes the trailing end and the trailing end so far becomes the leading end.

Next, the controller 11 switches the driving of the second motor 19 to the forward rotation driving and causes the PF roller 20 and the EJ roller 21 rotate in the forward rotation direction again so as to start the transportation operation for the second surface (Step S620). The transportation operation for the second surface is processing in which the paper sheet of which the second surface faces the image reading unit 12 side is transported toward the downstream side along the transportation path R (mainly, first transportation path R1). When it is determined that the leading end of the paper sheet M in the middle of the reverse transportation operation is in contact with the PF roller 20 (abuts on the PF roller 20 rotating in the reverse direction) due to an increase in burden on the second motor 19, the controller 11 switches the driving of the second motor 19 from the reverse rotation driving to the forward rotation driving. In this way, it is possible to end the reverse transportation operation (Step S610) and to start the transportation operation for the second surface.

After the transportation operation for the second surface is started (Step S620), the controller 11 separates the EJ roller 21 from the transportation path R (Step S630). Specifically, the controller 11 moves the EJ roller 21 from a first position PS1 which is a current position in which the EJ roller 21 can be in contact with the paper sheet M to a second position PS2 in which the EJ roller 21 cannot be in contact with the paper sheet M (a position separated from the transportation path R). The upper one of FIGS. 12A and 12B (FIG. 12A) illustrates the paper sheet M right before the transportation operation for the second surface is started. As understood from FIG. 12A, when the transportation operation for the second surface is started, the leading end of the paper sheet M is in contact with the PF roller 20 and the paper sheet M is in contact with the EJ roller 21 (is likely to be in contact with the EJ roller 21). When the transportation operation for the second surface is continuously performed in this state, due to the PF roller 20 and the EJ roller 21 rotating in the forward rotation direction, one paper sheet M is pulled toward the opposite sides. In order to avoid such a state, the controller 11 performs the separation of the EJ roller 21 as described above. FIG. 12A illustrates a state where the EJ roller 21 is located in the first position PS1 (a state before the separation).

In the third embodiment, it is assumed that a delay mechanism for delaying the start of rotation of the EJ roller 21 is provided between the second motor 19 and the EJ roller 21. The delay mechanism is realized by a coupling (shaft coupling) connecting a shaft of the second motor 19 and a shaft of the EJ roller 21. The coupling includes a first disk positioned close to the shaft of the second motor 19 and a second disk positioned close to the shaft of the EJ roller 21. The first disk includes a pin which protrudes toward the second disk side on a surface facing a surface of the second disk. The pin is in a state of being inserted into a groove formed on the surface of the second disk and the groove has a predetermined length so that the pin can move to some extent in the groove according to rotation of the first disk. Accordingly, even when the first disk starts to rotate at the same time as when the second motor 19 starts to rotate, the second disk starts to rotate after the pin moves by a distance corresponding to the length of the groove along with the first disk (rotation of the first disk is transferred to the second disk and the EJ roller 21 starts to rotate). According to such a delay mechanism, when the second motor 19 starts to rotate, the EJ roller 21 starts to rotate later than the start of rotation of the PF roller 20.

Due to the design of the delay mechanism, a time (delay time) by which the start of rotation of the EJ roller 21 is delayed with respect to the start of rotation of the PF roller 20 is determined in advance. Therefore, before the delay time passes after the transportation operation for the second surface is started (Step S620), the controller 11 separates the EJ roller 21 from the transportation path R (Step S630). By separating the EJ roller 21 as described above, it is possible to avoid a state where one paper sheet M is pulled toward the opposite sides due to the PF roller 20 and the EJ roller 21 rotating in the forward rotation direction, and it is possible to smoothly perform the transportation operation for the second surface of the paper sheet M. A specific method of moving the EJ roller 21 is not limited and any method can be used as long as the EJ roller 21 is moved between the first position PS1 and the second position PS2. For example, the controller 11 may move the EJ roller 21 using a driving force generated by the first motor 16. Alternatively, the controller 11 may move the EJ roller 21 by controlling an electromagnet for moving the EJ roller 21 toward the second position PS2 against a urging force of an elastic body (for example, spring) that urges the EJ roller 21 so as to maintain the position of the EJ roller 21 to be in the first position PS1.

After the EJ roller 21 is separated from the transportation path R, the controller 11 determines whether or not a time (return timing) for returning the EJ roller 21 to the transportation path R has been reached (Step S640). Then, when it is determined that the return timing has been reached ("Yes" in Step S640), the controller 11 returns the EJ roller 21 to the transportation path R (Step S650). That is, the controller 11 moves the EJ roller 21 to the first position PS1 from the second position PS2. The return timing is a time slightly earlier than when the trailing end of the paper sheet M in the middle of the transportation operation for the second surface passes through the PF roller 20. In other words, the controller 11 needs to return the EJ roller 21 to the transportation path R at an appropriate time earlier than when the trailing end of the paper sheet M in the middle of the transportation operation for the second surface passes through the PF roller 20. The lower one of FIGS. 12A and 12B (FIG. 12B) illustrates the paper sheet M right before the return timing. In FIG. 12B, the EJ roller 21 is located in the second position PS2.

The controller 11 determines the return timing on the basis of the paper sheet length Lm of the paper sheet M. As clearly understood from the above description, the controller 11 has already stored the paper sheet length Lm of the paper sheet M having been subject to the reading processing. In the third embodiment, the controller 11 stores the paper sheet length Lm of the paper sheet M when the image reading unit 12 finishes the reading processing with respect to the paper sheet M in the middle of the transportation operation for the first surface of the paper sheet M (Step S600). The controller 11 calculates a time taken from when the leading end of the paper sheet M passes through the end portion detection sensor 13 to when a portion on the leading end side of the paper sheet M which is several centimeters distant from the trailing end passes through the PF roller 20, on the basis of the paper sheet length Lm of the paper sheet M which is obtained in the transportation operation for the first surface and a predetermined rotation rate of the second motor 19 (and the distance between the end portion detection sensor 13 and the contact point between the PF roller 20 and the paper sheet M, which is a fixed value). In addition, the controller 11 determines that the return timing has been reached when the calculated time has been reached by the time which has elapsed after the leading end of the paper sheet M is detected by the end portion detection sensor 13 in the last phase of the reverse transportation operation (Step S610).

According to this configuration, the controller 11 can return the EJ roller 21 to the transportation path R before the trailing end of the paper sheet M in the middle of the transportation operation for the second surface passes through the PF roller 20. After the EJ roller 21 returns to the transportation path R, the paper sheet M is transported to the downstream side with the EJ roller 21 rotating (forward rotation), and thus it is possible to smoothly perform the transportation operation for the second surface even after the trailing end of the paper sheet M passes through the PF roller 20. After the return of the EJ roller 21, the controller 11 discharges the paper sheet M (Step S660). The discharging in Step S660 is executed by only continuously rotating the PF roller 20 and the EJ roller 21. Therefore, it can be said that the discharging is substantially a portion of the transportation operation for the second surface. It is needless to say that the image reading unit 12 finishes the reading processing with respect to the second surface of the paper sheet M in the middle of the transportation operation for the second surface. However, the second transportation operation (transportation operation for second surface in second transportation operation) may be stopped when the image reading unit 12 finishes the reading processing with respect to the second surface of the paper sheet M, and the second transportation operation may be restarted after the inclination correction processing with respect to the following paper sheet M2 ends.

According to the third embodiment, since the controller 11 determines the return timing on the basis of the paper sheet length Lm of the paper sheet M, it is possible to return the EJ roller 21, which has been separated from the transportation path R in the initial phase of the transportation operation for the second surface, to the transportation path R at an appropriate time and to smoothly perform the transportation operation for the second surface. In addition, according to the third embodiment, there is provided a transportation apparatus in which the second transportation unit is provided with a transportation roller that transports a paper sheet being positioned on the downstream side in the transportation direction of the processing unit and a discharging roller that discharges the transported paper sheet being positioned on the downstream side in the transportation direction of the processing unit, the transportation apparatus being provided with a first transportation path along which the paper sheet is transported from the transportation roller and reaches the discharging roller passing through the processing unit and a second transportation path along which the paper sheet is returned from the discharging roller to the transportation roller without passing through the processing unit, and in a case where the controller causes the processing unit to execute processing with respect to the both surfaces of the paper sheet, after processing with respect to a first surface, which is executed by the processing unit according to transportation of the paper sheet along the first transportation path, the controller causes the processing unit to execute processing with respect to a second surface, which is on the rear side of the first surface, while returning the paper sheet to the first transportation path via the second transportation path, and moves the discharging roller from a second position in which the discharging roller cannot be in contact with the paper sheet to a first position in which the discharging roller can be in contact with the paper sheet before the trailing end of the paper sheet is moved to the downstream side in the transportation direction of the transportation roller in the middle of the processing with respect to the second surface performed by the processing unit.

5. Modification Example

As described in the second embodiment, respective predetermined rotation rates are determined as rotation rates of the first motor 16 and the second motor 19, and in a normal state (except for the high speed transportation operation), the first motor 16 and the second motor 19 are operated using the predetermined rotation rates. Here, the rotation rate (predetermined rotation rate) of the first motor 16 may be the same as the rotation rate (predetermined rotation rate) of the second motor 19. That is, the rotation rates of the motors 16 and 19 are equalized. Since the rotation rates of the two motors 16 and 19 are equalized, noises generated by the two motors 16 and 19 become constant and a user becomes less unpleased compared to a case where noises generated by the two motors 16 and 19 with different rotation rates.

However, in order to realized smooth paper sheet transportation, rotation rates of the first motor 16 and the second motor 19 may be set to be different from each other. For example, the rotation rate of the first motor 16 may be set to be equal to or less than the rotation rate of the second motor 19. When the rotation rate of the motor (second motor 19) that takes charge of transportation on the downstream side in the transportation path R is set to be relatively high, a possibility of a paper jam in the transportation path R is reduced.

In a case where the rotation rates of the first motor 16 and the second motor 19 are set to be different from each other, in a housing of the reading apparatus 10, a motor with a low rotation rate may be disposed in a position close to the front side and a motor with a high rotation rate may be disposed in a position close to the rear side. It can be said that the front side of the reading apparatus 10 is the side that a user faces and is the side close to the user operating the reading apparatus 10. In addition, the operation input unit 24 is provided close to the front side on a surface of the housing of the reading apparatus 10. Since the motor with a relatively low rotation rate is provided in a position close to the front side, the level of the noise sensed by the user can be lowered.

The reading apparatus 10 has been exemplified as a specific example of the transportation apparatus according to the invention so far. However, the transportation apparatus is not limited to the reading apparatus. For example, the transportation apparatus may be a printing apparatus. That is, the processing unit that executes predetermined processing with respect to the paper sheet M transported by the second transportation unit 23 may be a printing unit (mechanism including printing head that ejects ink or the like) that executes printing with respect to the paper sheet M and the transportation apparatus may perform the first transportation operation and the second transportation operation as described above in order to subject the paper sheet M to printing. In this case, the printing unit has a sensing function of detecting the transported paper sheet also.

The entire disclosure of Japanese Patent Application No. 2016-022411, filed Feb. 9, 2016 is expressly incorporated by reference herein.

What is claimed is:

1. A transportation apparatus comprising:

a first transportation unit that transports a paper sheet from a mounting portion on which the paper sheet is mounted;

a second transportation unit that transports the paper sheet transported by the first transportation unit being positioned on a downstream side of the first transportation unit in a transportation direction;

a processing unit that executes predetermined processing with respect to the paper sheet transported by the second transportation unit; and a controller that controls driving of the first transportation unit and the second transportation unit, wherein the controller measures a transportation time of an Nth paper sheet (N is an integer of 1 or more) from when the second transportation unit starts to transport the Nth paper sheet until when the processing unit finishes processing with respect to the Nth paper sheet, determines a specific time which is shorter than the transportation time of the Nth paper sheet on the basis of the transportation time of the Nth paper sheet, causes the first transportation unit to start transportation of an (N+2)th paper sheet at a time when the specific time has elapsed after the second transportation unit starts to transport an (N+1)th paper sheet, and repeats the process of measuring the transportation time, determining the specific time and causing to start transportation by the first transportation unit for the (N+1)th and subsequent paper sheets.

2. The transportation apparatus according to claim 1, wherein the first transportation unit is driven by a first motor, the second transportation unit is driven by a second motor, and the controller individually controls driving of the first motor and driving of the second motor.

3. The transportation apparatus according to claim 1, wherein the processing unit is an image reading unit which executes reading processing with respect to the paper sheet transported by the second transportation unit.

4. The transportation apparatus according to claim 1, further comprising:

an end portion detection sensor that detects an end portion of a paper sheet being positioned on a downstream side of the mounting portion in the transportation direction and on a upstream side of the second transportation unit in the transportation direction, wherein the controller calculates the specific time by subtracting Y from X, where X is the time taken from when the first transportation unit starts to transport the paper sheet from the mounting portion to when a leading end of the transported paper sheet is detected by the end portion detection sensor and Y is the transportation time.

5. The transportation apparatus according to claim 4, wherein the controller measures and updates the time X each time when the first transportation unit transports a paper sheet.

6. The transportation apparatus according to claim 1, wherein the controller executes inclination correction processing in which the first transportation unit is further driven in a state where a leading end of a paper sheet transported by the first transportation unit is in contact with the second transportation unit being stopped so that the second transportation unit transports the paper sheet having been subject to the inclination correction processing.

7. The transportation apparatus according to claim 6, wherein the controller does not execute the inclination correction processing during a period from when the second transportation unit starts to transport a paper sheet to when the processing unit finishes the processing.

8. The transportation apparatus according to claim 1, wherein the second transportation unit is provided with a discharging unit that discharges a transported paper sheet being positioned on a downstream side of the processing unit in the transportation direction, and transportation of a paper sheet to be subject to the processing in the processing unit and discharging of a paper sheet having been subject to the processing in the processing unit which is performed by the discharging unit are executed being synchronized with each other.

9. The transportation apparatus according to claim 1, wherein the controller measures and updates the transportation time each time when the second transportation unit transports a paper sheet.

10. The transportation apparatus according to claim 1, further comprising:

an end portion detection sensor that detects an end portion of a paper sheet being positioned on a downstream side of the mounting portion in the transportation direction and on a upstream side of the second transportation unit in the transportation direction, wherein the controller calculates a length of a paper sheet in the transportation direction on the basis of transportation of the paper sheet performed by the second transportation unit, speeds up the transportation of a paper sheet which is performed by the first transportation unit in a case where a time at which a trailing end of a paper sheet which the second transportation unit starts to transport is detected by the end portion detection sensor is earlier than timing of detection expected from the calculated length of the paper sheet, and temporarily stops the transportation of a paper sheet which is performed by the first transportation unit in a case where the time at which the trailing end of the paper sheet which the second transportation unit starts to transport is detected by the end portion detection sensor is later than the expected timing of detection.

11. The transportation apparatus according to claim 10, wherein, after the controller speeds up the transportation of a paper sheet which is performed by the first transportation unit, in a case where a leading end of a paper sheet transported by the first transportation unit is detected by the end portion detection sensor, the controller temporarily stops the transportation of the paper sheet which is performed by the first transportation unit before the leading end comes into contact with the second transportation unit, and the controller restarts the transportation of the paper sheet which is performed by the first transportation unit after the processing unit finishes processing with respect to the paper sheet transported by the second transportation unit.

12. The transportation apparatus according to claim 10, wherein, after the controller temporarily stops the transportation of a paper sheet which is performed by the first transportation unit since the time at which the trailing end of the paper sheet which the second transportation unit starts to transport is detected by the end portion detection sensor is later than the expected timing of detection, the controller restarts the transportation of the paper sheet which is performed by the first transportation unit after the processing unit finishes processing with respect to the paper sheet transported by the second transportation unit.

13. The transportation apparatus according to claim 1, wherein the first transportation unit includes a one-way clutch that transmits a rotational force only in a paper sheet feeding direction being positioned on a downstream side of the first transportation unit in the transportation direction.

* * * * *